US011482136B2

(12) United States Patent
Artale et al.

(10) Patent No.: US 11,482,136 B2
(45) Date of Patent: Oct. 25, 2022

(54) DISPLAY ASSEMBLY WITH MODULAR CONNECTORS

(71) Applicant: Atomic Design, Inc., Lititz, PA (US)

(72) Inventors: Nicolas Artale, Lancaster, PA (US); Conway S. Allison, East Petersburg, PA (US)

(73) Assignee: Atomic Design, Inc., Lititz, PA (US)

( * ) Notice: Subject to any disclaimer, the term of this patent is extended or adjusted under 35 U.S.C. 154(b) by 0 days.

(21) Appl. No.: 17/081,353

(22) Filed: Oct. 27, 2020

(65) Prior Publication Data

US 2022/0130286 A1 Apr. 28, 2022

(51) Int. Cl.
*G09F 7/20* (2006.01)
*G09F 7/18* (2006.01)

(52) U.S. Cl.
CPC ..... *G09F 7/20* (2013.01); *G09F 2007/1843* (2013.01); *G09F 2007/1891* (2013.01)

(58) Field of Classification Search
CPC ..... A47G 1/065
USPC ..... 40/729, 730
See application file for complete search history.

(56) References Cited

U.S. PATENT DOCUMENTS 3,070,914 A * 1/1963 Henderson ..... A47G 1/065 40/730
3,339,302 A * 9/1967 Mallory ..... A47G 1/065 40/729
4,017,989 A * 4/1977 Murray ..... A47G 1/065 40/731
4,115,938 A * 9/1978 Belmuth ..... A47G 1/065 40/730
4,712,322 A 12/1987 Rubin
4,912,863 A * 4/1990 Harvey ..... A47G 1/065 40/730
5,071,281 A * 12/1991 Murphy ..... A47G 1/065 403/295

(Continued)

FOREIGN PATENT DOCUMENTS

CN 201584124 U1 9/2010
CN 110285124 A 9/2019

(Continued)

OTHER PUBLICATIONS

PCT International Search Report and Written Opinion, Application No. PCT/US2021/056843, dated Mar. 21, 2022, 14 pages.

*Primary Examiner* — David R Dunn
*Assistant Examiner* — Christopher E Veraa
(74) *Attorney, Agent, or Firm* — Barley Snyder

(57) ABSTRACT

A modular display system includes a plurality of frames, each frame comprising a sidewall connected to a sidewall of another one of the frames by a frame connector. A panel is removably attached to a front face of at least one of the plurality of frames by a panel connector. A border element is attached to the sidewall of one of the plurality of frames by a border connector. The system is secured to a mounting surface via a cleat removably mounted to a sidewall of one of the plurality of frames. Each of the frames includes a plurality of connector receiving sections arranged about a perimeter thereof. The connector receiving sections define a commonly sized recess formed through the sidewall of the frame in a width direction thereof and are configured to accept each of the frame connector, the border connector and the cleat therein.

17 Claims, 22 Drawing Sheets

(56) References Cited

U.S. PATENT DOCUMENTS 5,214,893 A * 6/1993 Clement ..... A47G 1/0644 160/377
5,246,304 A * 9/1993 John ..... A47G 1/065 403/403
5,761,839 A * 6/1998 Heikkila ..... G09F 7/08 40/730
6,054,968 A * 4/2000 De Matteo ..... G09F 15/0068 312/7.2
6,347,472 B1 * 2/2002 Dominguez ..... A47G 1/02 40/605
6,729,057 B1 5/2004 Lu
7,373,747 B1 * 5/2008 Wiemer ..... G09F 7/00 40/600
2006/0201039 A1 * 9/2006 Gilliland ..... A47G 1/065 40/605
2007/0151136 A1 * 7/2007 Dandie ..... A47G 1/0627 40/711
2009/0013577 A1 * 1/2009 Barnard ..... A47G 1/065 40/731
2009/0317599 A1 * 12/2009 Heuman ..... B44C 3/12 428/189
2014/0047747 A1 * 2/2014 Jackson ..... G09F 15/0012 40/730
2016/0073796 A1 * 3/2016 Nesbitt ..... A47G 1/065 40/711
2016/0345754 A1 * 12/2016 Hogrefe ..... A47G 1/065
2017/0084208 A1 * 3/2017 Durant ..... G09F 7/04
2018/0031919 A1 2/2018 Ryu et al.
2018/0180077 A1 * 6/2018 White ..... F16B 7/187
2019/0020131 A1 * 1/2019 Aaron ..... H01R 4/48

FOREIGN PATENT DOCUMENTS

KR 20140121579 A1 10/2014
WO 2018147073 A1 12/2008
WO 2017143387 A1 8/2017

* cited by examiner

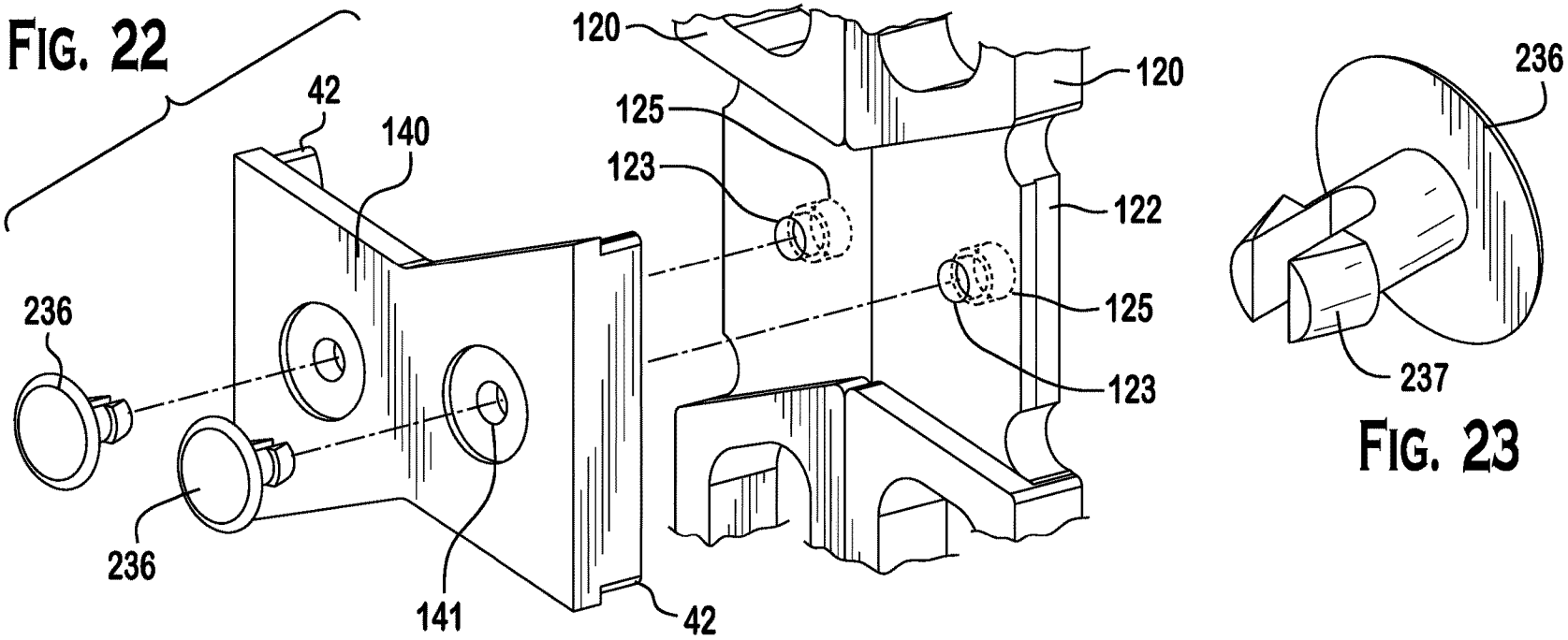
FIG. 22
FIG. 23
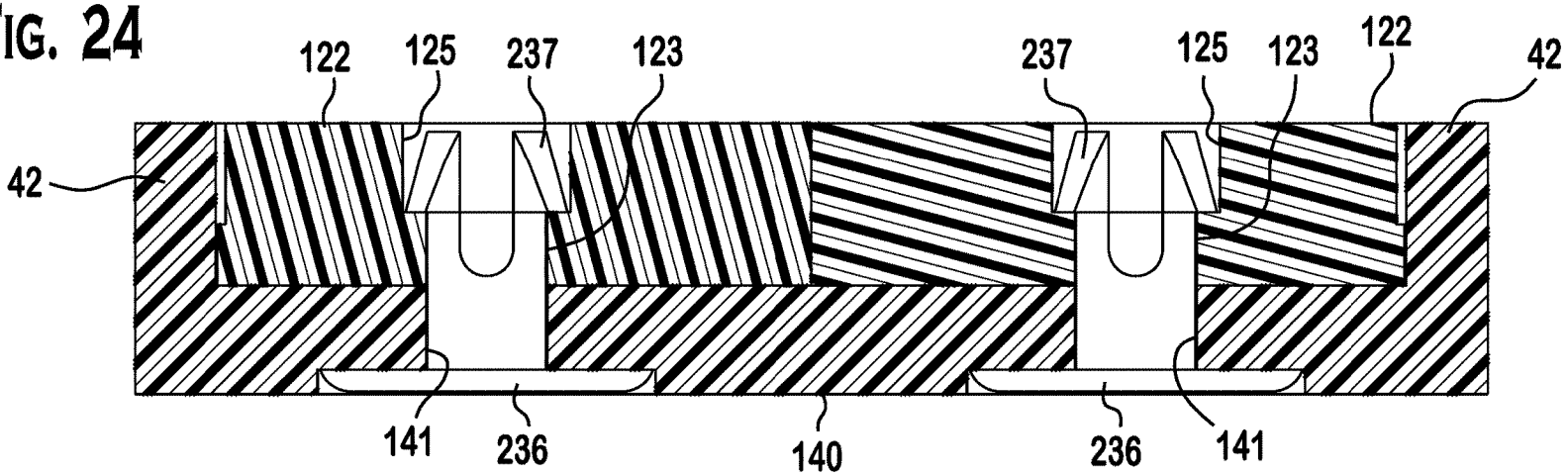
FIG. 24

DISPLAY ASSEMBLY WITH MODULAR CONNECTORS

FIELD OF THE INVENTION

The present disclosure relates to display systems, and more particularly, to a display assembly including a modular framing and connector system.

BACKGROUND

Visual displays are widely used for many different purposes including marketing, sales and entertainment. Displays or other visual elements may take on many different forms (e.g., shapes and sizes) depending on both artistic and structural specifications of the element. Production and installation of these displays or other design elements, particular in large-scale, are often time consuming, mechanically complex and thus costly. Further, many of these displays may be used only temporarily, leading to unnecessary waste, or may require periodic artistic and/or structural alterations thereto. These updates are likewise time consuming as well as expensive.

Accordingly, there is a need for a display system or assembly which is modular in nature, and offers convenient assembly and scalability, as well as a system which is easily modifiable and reusable both structurally as well as artistically. There is also a need for a display and framing system which utilizes as many common or shared parts as possible, further increasing efficiency and usability.

SUMMARY

In one embodiment of the present disclosure, a modular display system or assembly is provided. The system includes a plurality of interconnected frames, with each of the frames having a sidewall connected to a sidewall of another one of the frames by a frame connector. At least one panel is removably attached to a front face of at least one of the plurality of interconnected frames by a panel connector. The system further includes a border element removably attached to an exterior side of a sidewall of one of the plurality of interconnected frames by a border connector. The system is mountable to an adjacent mounting surface, such as a wall, via a mounting cleat extending from a sidewall of one of the plurality of interconnected frames. Each of the frames incudes a plurality of connector receiving sections defined by at least one sidewall of the frame and arranged about a perimeter thereof. The connector receiving sections define a commonly-sized recess formed through the at least one sidewall in a width direction thereof and are configured to accept each of the frame connector, the border connector and the mounting cleat therein.

In another embodiment, a modular display system includes a plurality of frames. Each of the frames include at least one sidewall and a plurality of connector receiving sections defined by the at least one sidewall and arranged about a perimeter of the frame. Each connector receiving section defines a recess formed through the at least one sidewall in a width direction thereof. The system further includes at least one frame connector selectively fixable within connector receiving sections of two frames of the plurality of frames for connecting the two frame sidewalls together. The recess of each connector receiving section includes a profile tapering in the width direction from an interior side of the at least one sidewall to an exterior side of the sidewall.

Other objects and advantages of the present invention will be apparent by the following description with reference to the accompanying drawings and will be helpful for a comprehensive understanding to the present invention.

BRIEF DESCRIPTION OF THE DRAWINGS

The above and other features of the disclosure will become more apparent by describing in detail exemplary embodiments thereof with reference to the accompanying drawings, in which:

FIG. 22 is an exploded perspective view of another frame-to-frame connector and corresponding frame members according to an embodiment of the present disclosure;

FIG. 23 is a perspective view of another fastener useful for securing connectors according to embodiments of the present disclosure to frame members;

FIG. 24 is a cross-sectional view of the connector and frame members of FIG. 22 in an assembled state;

DETAILED DESCRIPTION OF THE EMBODIMENTS

Figure 1:
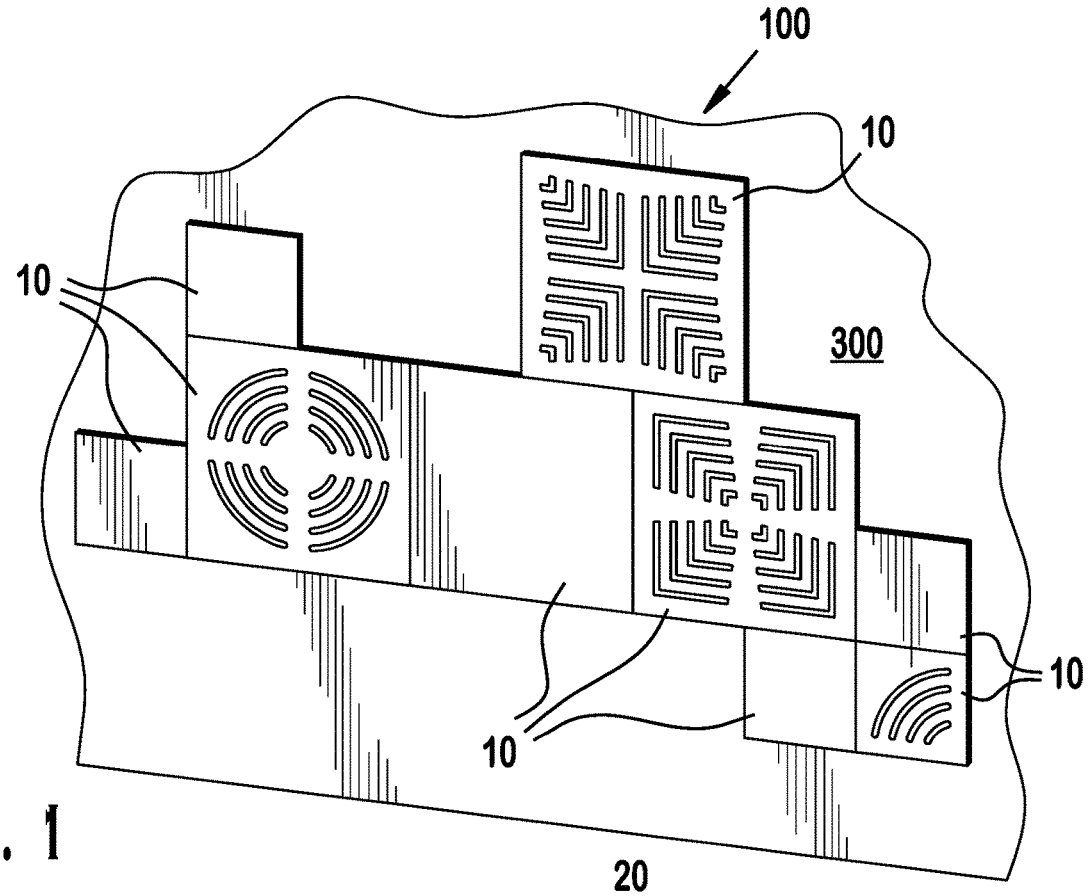
FIG. 1 is a perspective view of an assembled panel system according to an embodiment of the present disclosure.

It is to be understood that the figures and descriptions of the present invention have been simplified to illustrate elements that are relevant for a clear understanding of the present invention, while eliminating, for purposes of clarity, many other elements found in, for example, known systems. However, for sake of brevity and because such elements are well known in the art, and they do not facilitate a better understanding of the present invention, a discussion of such elements is not provided herein. The disclosure herein is directed to all such variations and modifications known to those skilled in the art.

In the following detailed description, reference is made to the accompanying drawings that show, by way of illustration, specific embodiments in which the invention may be practiced. It is to be understood that the various embodiments of the invention, although different, are not necessarily mutually exclusive. Furthermore, a particular feature, structure, or characteristic described herein in connection with one embodiment may be implemented within other embodiments without departing from the scope of the invention. In addition, it is to be understood that the location or arrangement of individual elements within each disclosed embodiment may be modified without departing from the scope of the invention. The following detailed description is, therefore, not to be taken in a limiting sense, and the scope of the present invention is defined only by the appended claims, appropriately interpreted, along with the full range of equivalents to which the claims are entitled. In the drawings, like numerals refer to the same or similar functionality throughout several views.

Embodiments of the present disclosure include modular panel display systems utilizing common or modular connectors having, for example, bow-tie, butterfly, dovetail, or halving joint features. The systems further utilize common fasteners throughout, including push-pin, expanding rivet, and/or ball and socket-type fasteners. Common connector profiles and shared fasteners facilitate the expedient joining of the system components, including the frames, panels, borders and mounting components. As shown in FIG. 1, an exemplary modular panel system or assembly 100 according to embodiments of the present disclosure is shown. The assembly 100 includes an arrangement of interconnected panels 10, which may be decorative and/or functional in nature and may be secured to a mounting surface 300, such as a wall. The panels 10 may varying in number, size, shape and/or exterior appearance, and may be assembled together in any desired configuration depending on the application, including functional and/or artistic design considerations.

Figure 2:
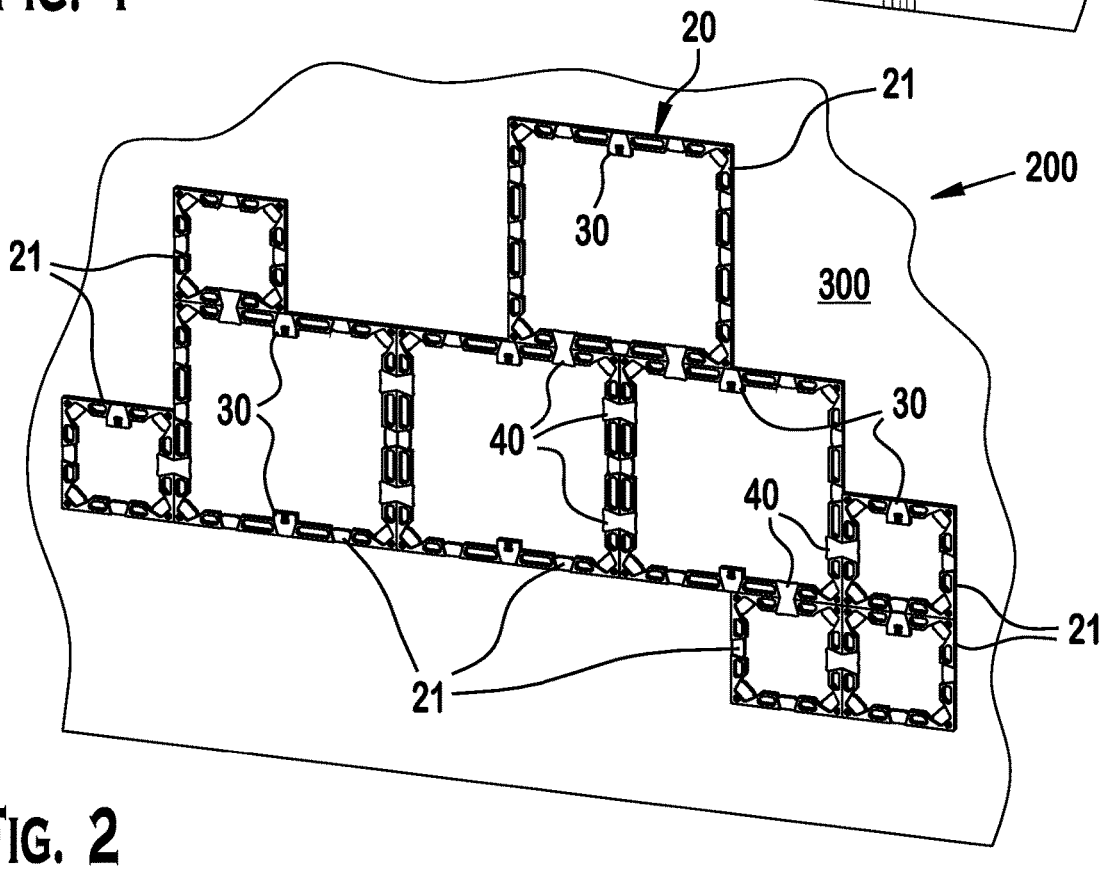
FIG. 2 is perspective view of the panel system of FIG. 1, with the exterior panels removed to reveal a modular frame assembly.
Figure 3:
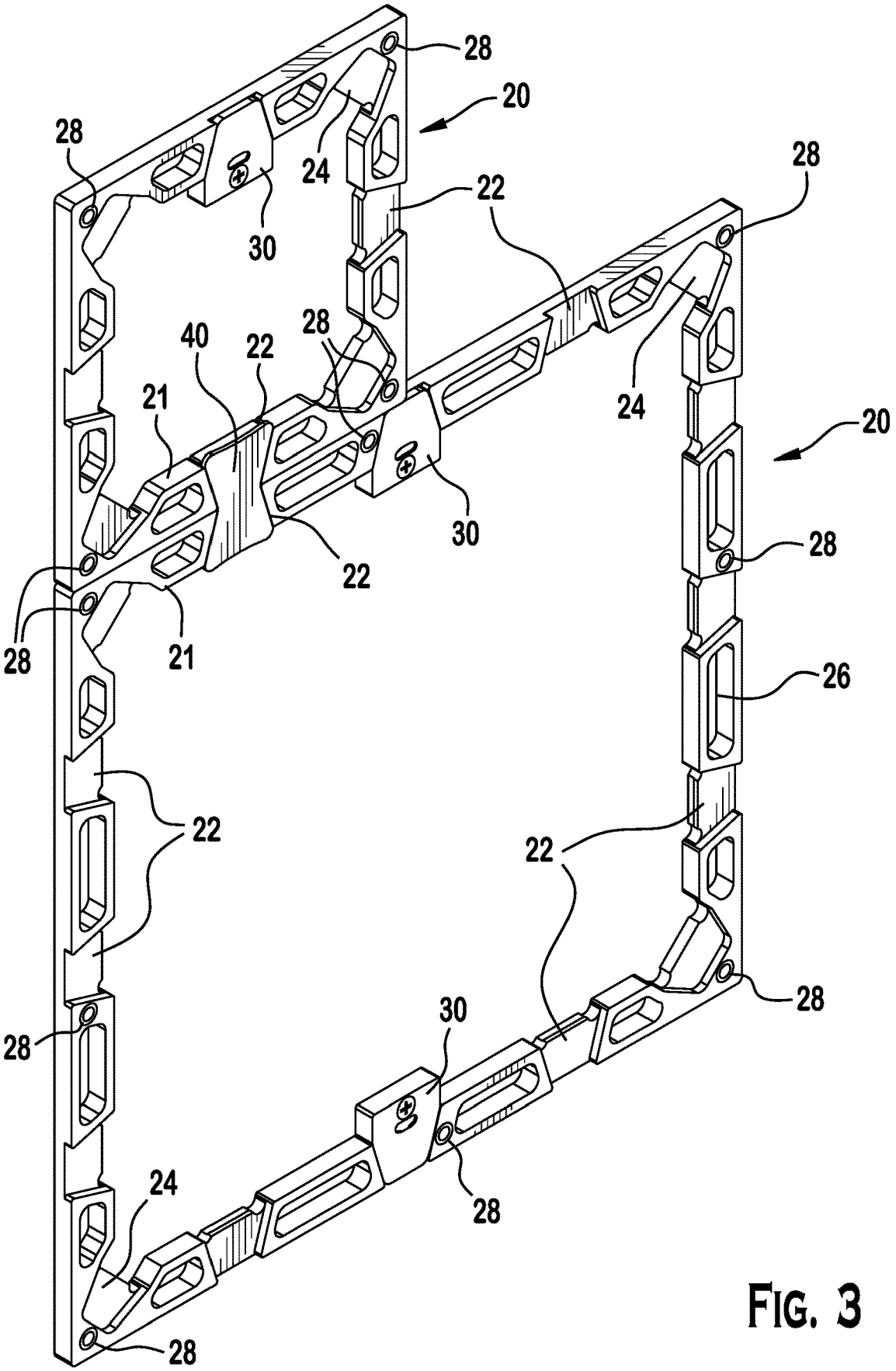
FIG. 3 is perspective view of a portion of the frame assembly of FIG. 2.

FIG. 2 illustrates the panel assembly 100 of FIG. 1, with the panels 10 removed to reveal a frame assembly 200. The frame assembly 200 includes a plurality of interconnected frames 20, with each frame corresponding in size to one of the plurality of panels 10. Each frame may include a monolithic frame, in the illustrated exemplary embodiment, a monolithic polygon having a plurality (e.g., four) of sides, sidewalls or frame members 21 integrally formed with one another. In other embodiments, one or more sidewalls 21 of a frame 20 may include a discrete element mechanically fastened to one or more additional sidewalls to form the illustrated four-sided frames without departing from the scope of the present disclosure. With reference to FIGS. 2 and 3, each frame 20 may be connected to an adjacent frame via one or more frame-to-frame connectors or frame connectors 40. More specifically, adjacent or neighboring sidewalls 21 of each frame 20 are fixed to one another via the frame connector 40, with the frame connector fitted into opposing, correspondingly-sized first connector receiving sections 22 defined in each sidewall 21.

A cleat or hanger connector 30 may also be fitted to one or more of the connector receiving sections 22, and is configured to enable mounting of the frame 20 to, for example, a wall as will be set forth in further detail herein. As shown in the figures, each of the receiving sections 22 includes a standard size, and accepts multiple different types of connectors for providing maximum flexibility and configurability to the system. More specifically, each receiving section 22 may define a standard-sized recess formed into a top or front surface of the frame 20. The receiving sections 22 extend in a tapered manner through an entirety of a width of the sidewall 21 and in a direction from an interior of the frame to an exterior of the frame.

Each frame 20 further defines at least one panel connector 28, such as a receiving cup or socket fitted within a corresponding aperture formed in the frame 20, for removably connecting to a corresponding connector of a given panel 10 to be attached to the frame. In the exemplary embodiment, each frame 20 include a panel connector 28 arranged in each corner thereof. In other embodiments, additional panel connectors 28 may be arranged between the corners of the frame 20, and generally along one or more of the sidewalls 21 (e.g., in a middle section thereof). Second receiving sections 24 are defined in the corners of each frame 20, and are oriented in an angled manner with respect to adjacent sidewalls 21 of the frame 20. In particular, the receiving sections 24 are oriented such that their longitudinal axes generally bisect the right angle defined by the illustrated orthogonally-arranged sidewalls 21 of the frame. Still referring to FIGS. 2 and 3, the frames 20 may include a square frame of a first size and a square frame of a second size, with the second size being one-quarter that of the first size in planar area such that four interconnected frames of the second size are equal in size to a single frame of the first size. Each frame 20 further includes a plurality of openings 26 formed through each sidewall 21 thereof, reducing the overall weight of the frame.

Figure 4:
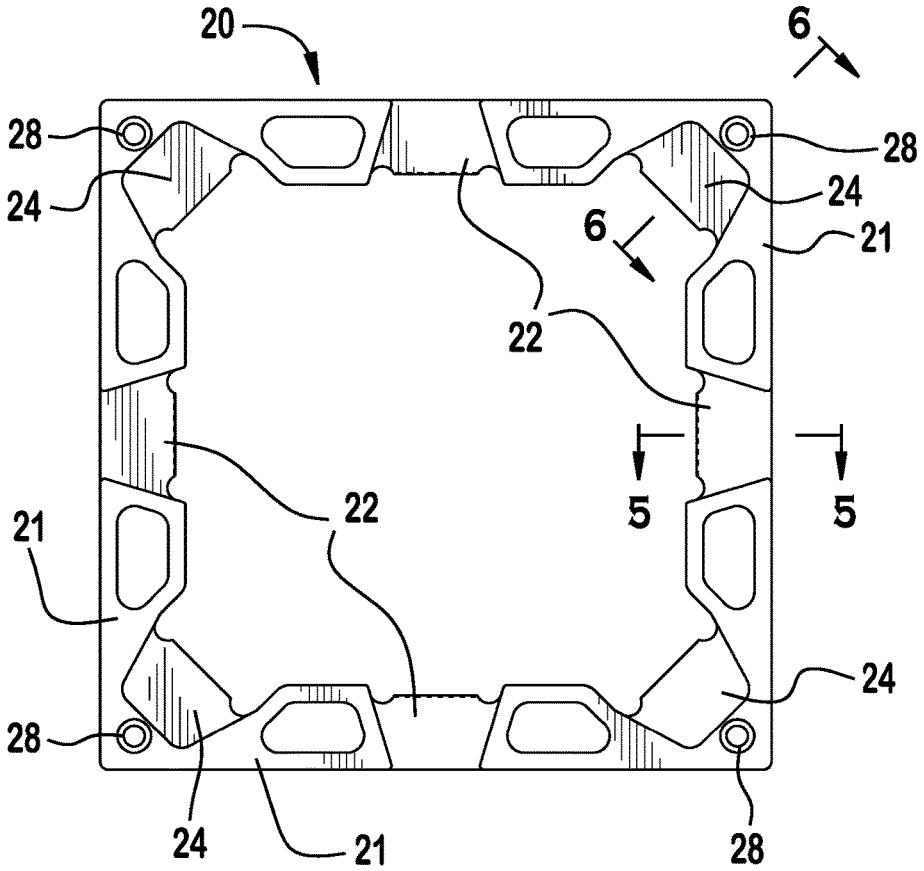
FIG. 4 is a front view of an exemplary frame according to an embodiment of the present disclosure.
Figure 5:
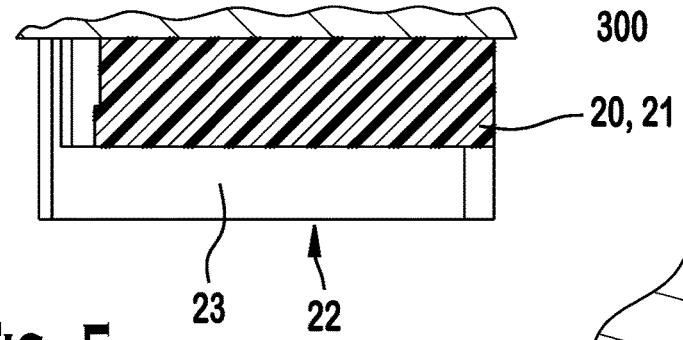
FIG. 5 is a first cross-sectional view of the frame of FIG. 4 taken along line 5-5 of FIG. 4.
Figure 6:
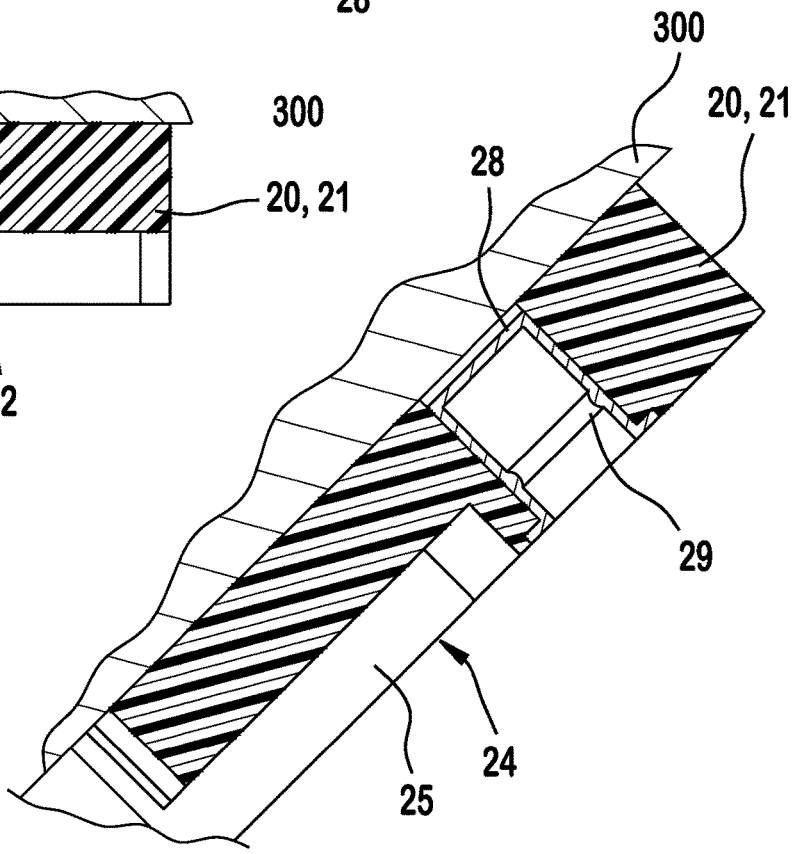
FIG. 6 is a second cross-sectional view of the frame of FIG. 4 taken along line 6-6 of FIG. 4.

FIGS. 4-6 illustrates the frame 20 of the second or smaller size in isolation. As shown in FIG. 4 and the cross-section 5-5 of FIG. 5, the receiving section 22 defines a recess 23 formed partially into the sidewall 21 to a first depth from a front surface thereof, with the recess extending in a tapered manner through an entire width of the sidewall 21. As shown in FIG. 4 and the cross-section 6-6 of FIG. 6, the second receiving section 24 defines a recess 25 having similar tapered profile to that of the recess 23. However, the recess 25 extends from an interior of the sidewalls(s) 21 outwardly through the sidewall to a point adjacent the panel connector 28, rather than entirely through the width of the sidewall(s) 21. Still referring to FIG. 6, the panel connector 28 defines an aperture including an annular locking protrusion 29 extending radially inward into the aperture. The panel connector 28 may include an aperture formed directly into the sidewall 21, or may include a separate cup or socket received within an aperture formed in the sidewall 21.

Figure 7:
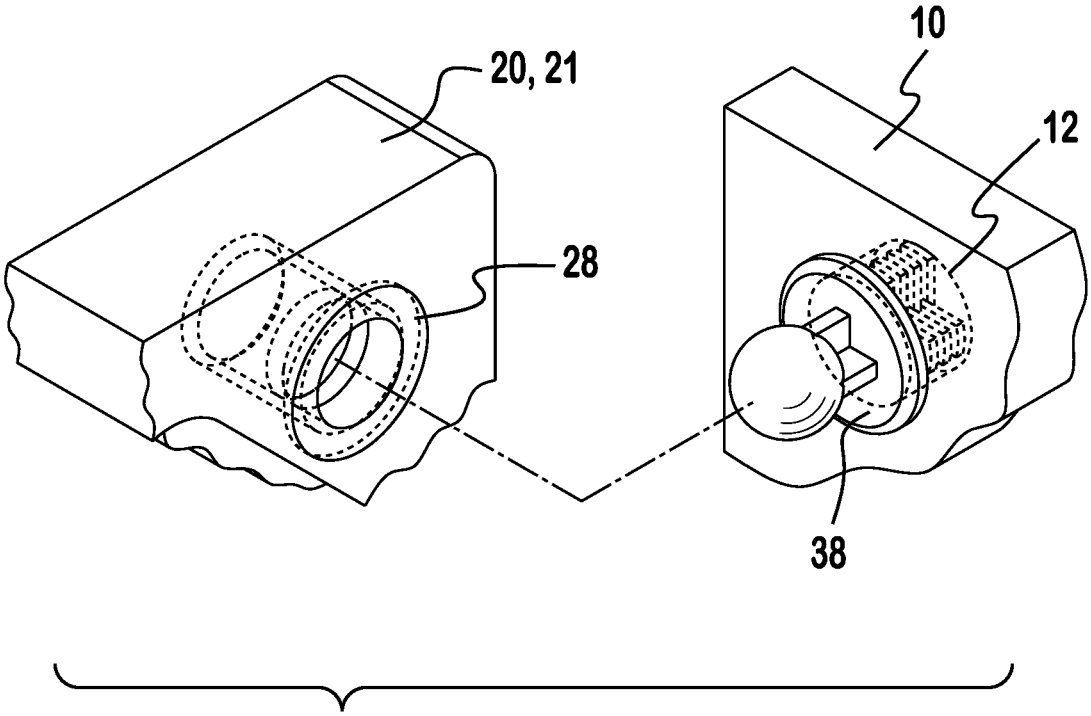
FIG. 7 is a partial perspective view of a panel connector or connector assembly according to an embodiment of the present disclosure in a detached state.
Figure 8:
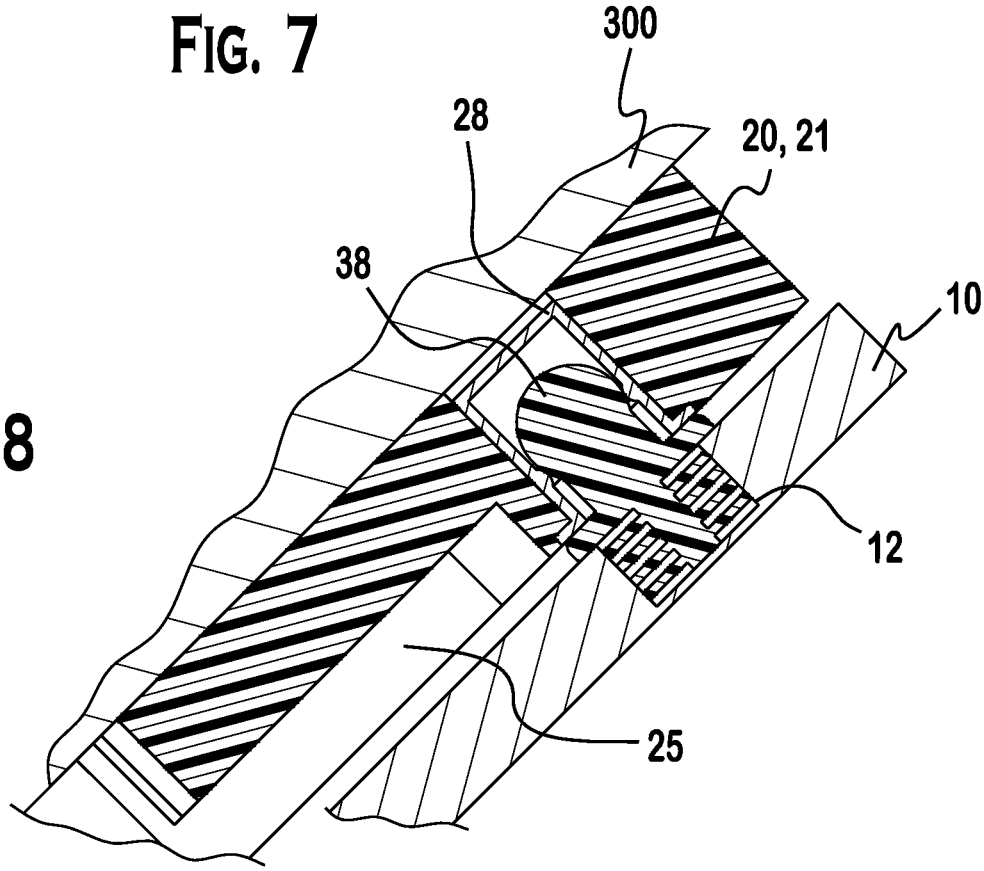
FIG. 8 is a cross-sectional view of the panel connector of FIG. 7 in an attached state.
Figure 9:
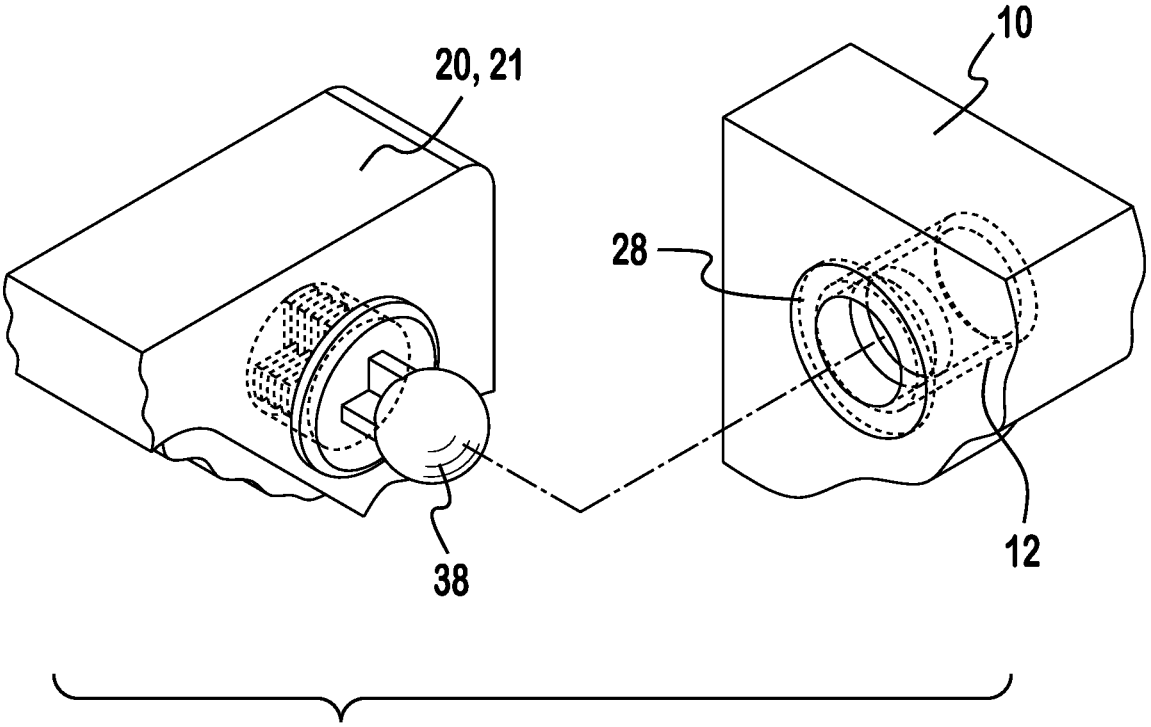
FIG. 9 is a partial perspective view of another panel connector to an embodiment of the present disclosure in a detached state.
Figure 10:
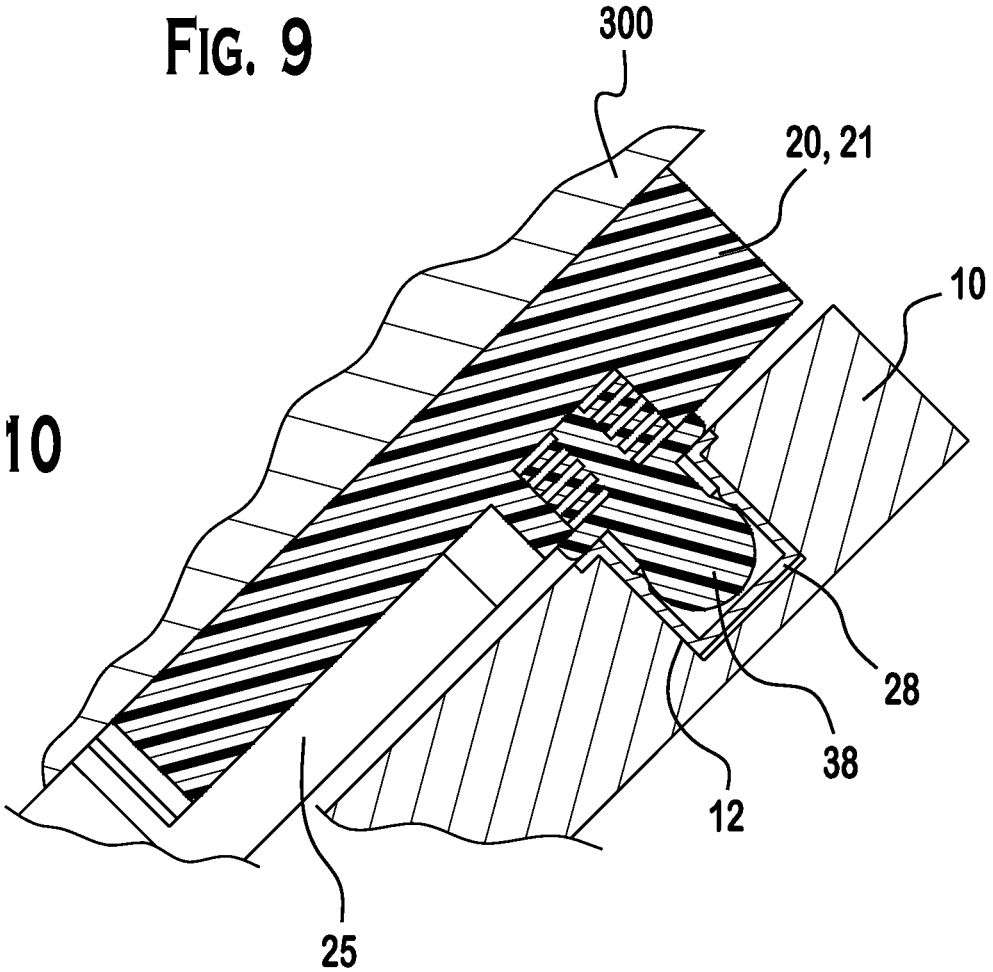
FIG. 10 is a cross-sectional view of the panel connector of FIG. 9 in an attached state.

FIGS. 7 and 8 illustrate the frame 20 fitted with the panel connector 28, and a corresponding panel 10 fitted with a complementary panel connector 38. The panel connector 38 includes a ball-like protrusion configured to be received within the panel connector 28 in a snap-fit manner, thereby defining a spherical detent arrangement, as shown in FIG. 8. Once inserted, the protrusion may be retained within the aperture of the panel connector 28 via the annular locking protrusion 29. An end of the panel connector 38 opposite the ball-like protrusion may define a plurality of radially extending elastic elements which may be press-fit into a corresponding aperture 12 of the panel 10, securing the panel connector 38 therein. Referring to FIGS. 9 and 10, the opposite arrangement to that of FIGS. 7 and 8 is shown, with the ball-like panel connector 38 fitted to the frame 20, and the receiving or female panel connector 28 defined by, or press-fit into, the panel 10.

Figure 11:
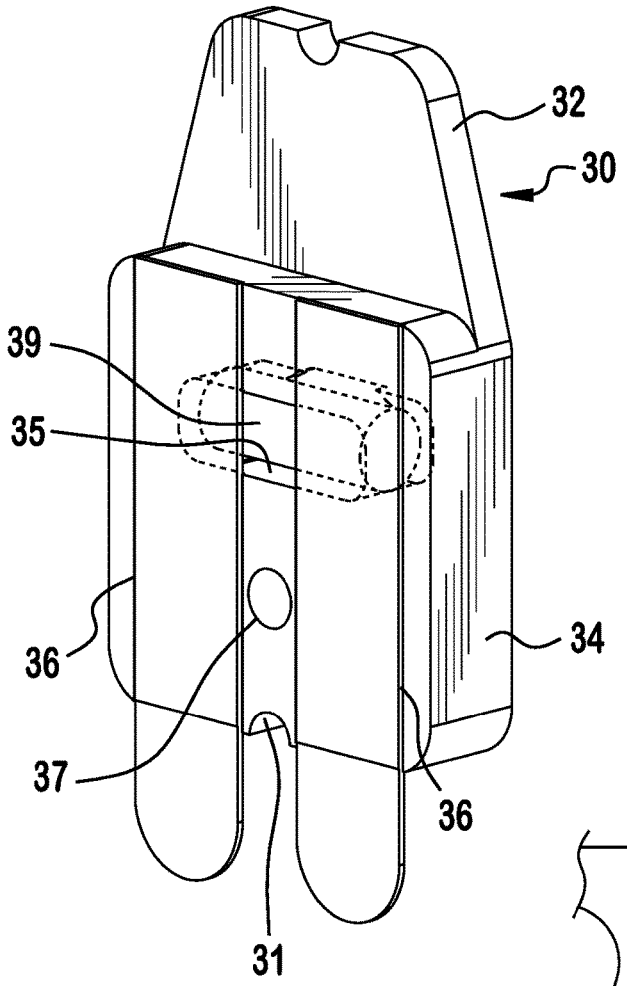
FIG. 11 is a perspective view of a cleat or hanger connector according to an embodiment of the present disclosure.
Figure 12:
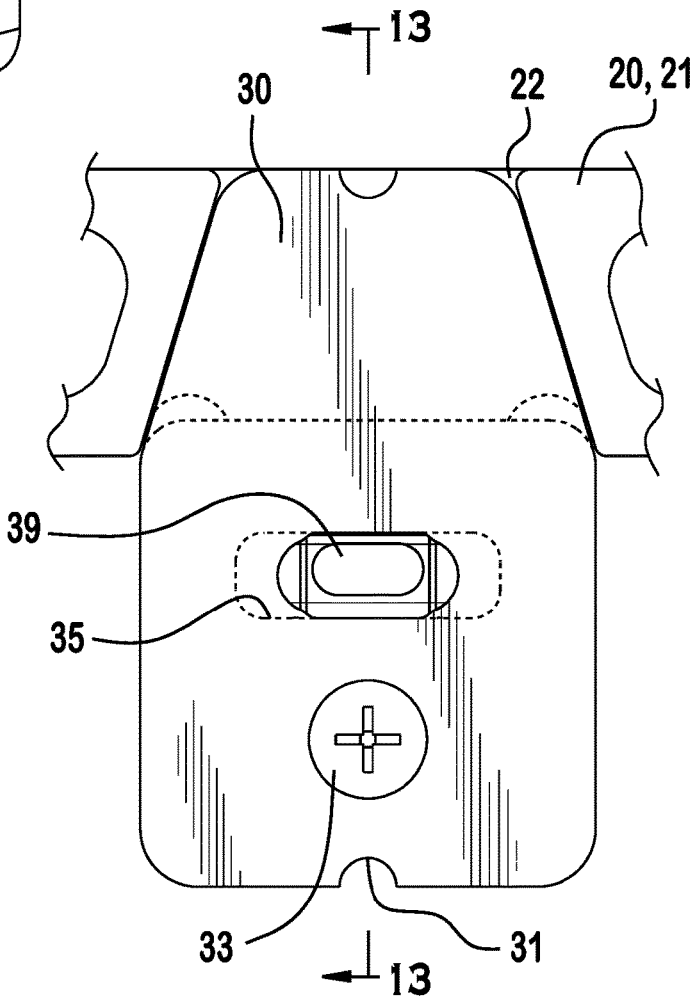
FIG. 12 is a front view of the cleat of FIG. 11 installed on a frame according to an embodiment of the present disclosure.
Figure 13:
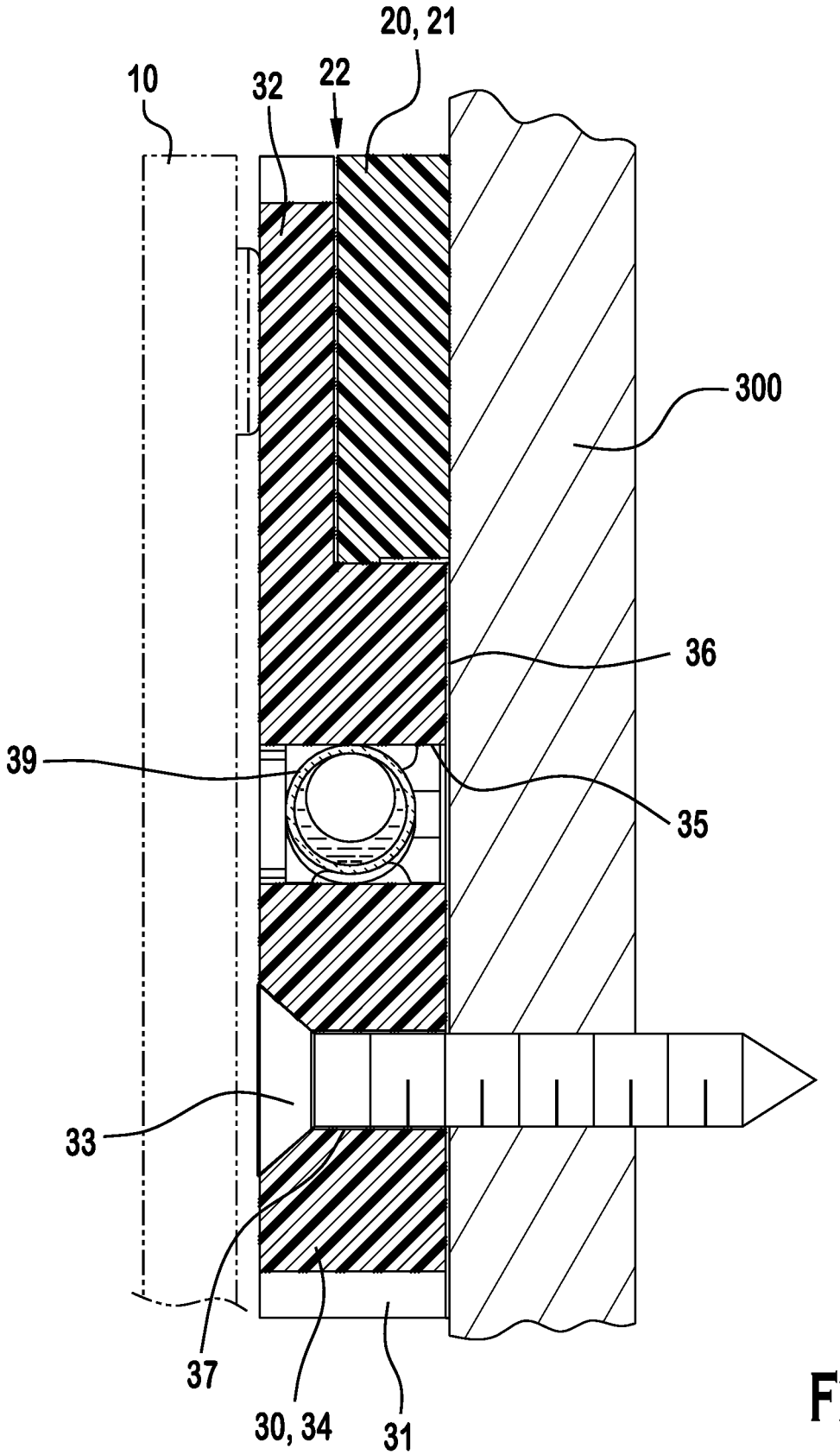
FIG. 13 is a cross-sectional view of the cleat and frame taken alone line 13-13 of FIG. 12, as mounted to a structure.

With reference to FIGS. 11-13, the cleat or hanger connector 30 according to an embodiment of the present disclosure includes a "half bow-tie" shaped mating portion 32 having a thickness and taper matching that of the receiving sections 22,24 into which it is adapted to be received. The cleat 30 further defines a mounting portion 34 having a thickness greater than that of the mating portion 32 and approximately equal to that of the frame 20 in an area outside of the receiving section 22,24. In this way, as shown in FIG. 13, a side of the mounting portion 34 of the cleat 30 is sized to be flush with the mounting surface 300. In the illustrated embodiment, the taper of the mating portion 32 generally narrows in a direction away from the mounting portion 34, and thus, the mounting portion is arranged within an interior of the frame 20. In other embodiments, the direction of the taper may be reversed, such that the mounting portion 34 is arranged on an exterior side of the frame 20 given the illustrated orientation of the receiving sections 22.

The mounting portion 34 further defines a through-hole 37 into which a fastener 33, such as a screw, may be passed for securing the cleat 30, and thus the panel(s) 20 associated therewith, to the mounting surface 300. The through-hole 37 may include a counter-sink or a counter-bore defined in the mounting portion 34 for recessing the head of the fastener 33, ensuring a panel 10 may be fitted thereover without interference, as shown in FIG. 13. The exemplary mounting portion 34 further includes a secondary aperture 35 which may be slotted in profile for receiving, for example, a cylindrical, fluid-filled vial, or bubble level 39, for aiding in accurately positioning the panel(s) 20. Moreover, the side of the mounting portion 34 facing the mounting surface 300 may be generally planar in profile, and defines a mounting surface to which a plurality of hook and loop and/or double-sided adhesive tabs or strips 36 may be applied or secured thereto for attaching the cleat 30 to the mounting surface. The use of adhesive strips 36 avoids permanent damage or unnecessary markings to the mounting surface 300, and enables tool-less mounting of the panel assembly 100. A notch 31 may be defined in the end of the mounting portion 34, and generally centered along its width. The notch 31 may define a mounting recess for engaging with a fastener for hanging the cleat, and/or for indicating the approximate placement location of the adhesive strips 36.

Figure 17:
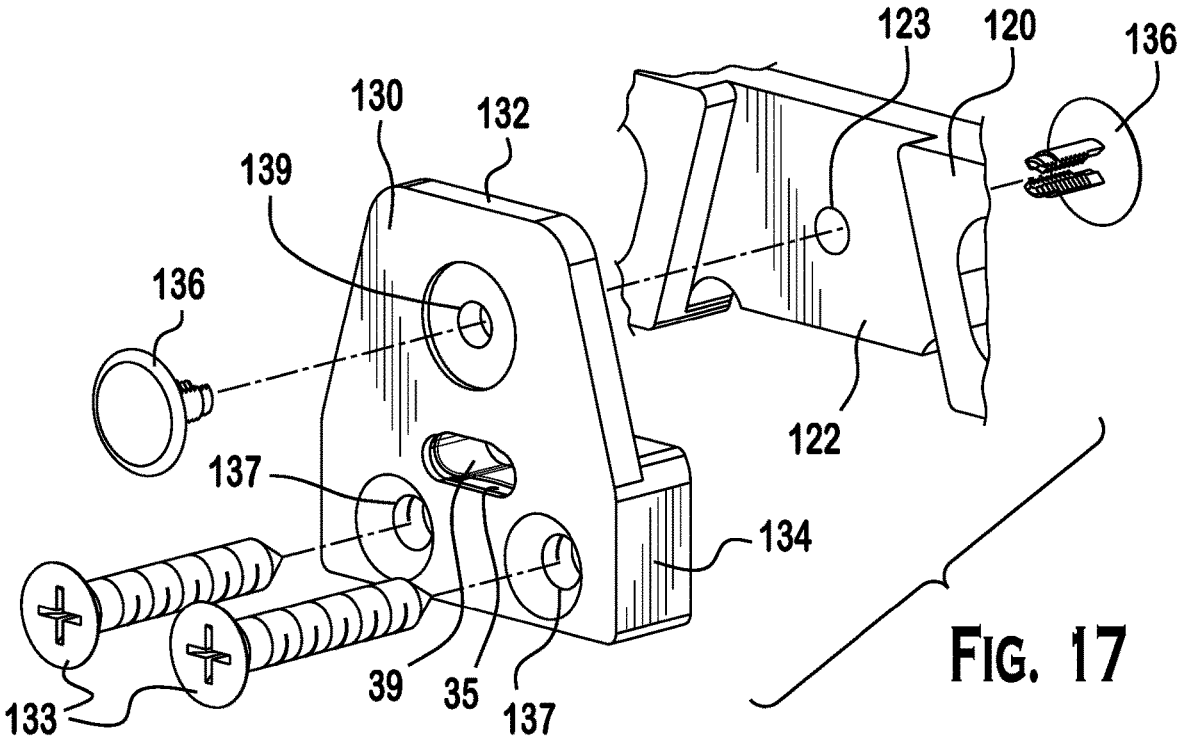
FIG. 17 is an exploded perspective view of another cleat or hanger connector and a corresponding frame member according to an embodiment of the present disclosure.
Figure 18:
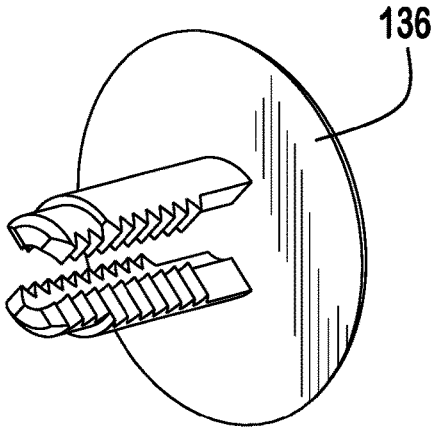
FIG. 18 is a perspective view of a portion of a fastener useful for securing connectors according to embodiments of the present disclosure to frame members.
Figure 19:
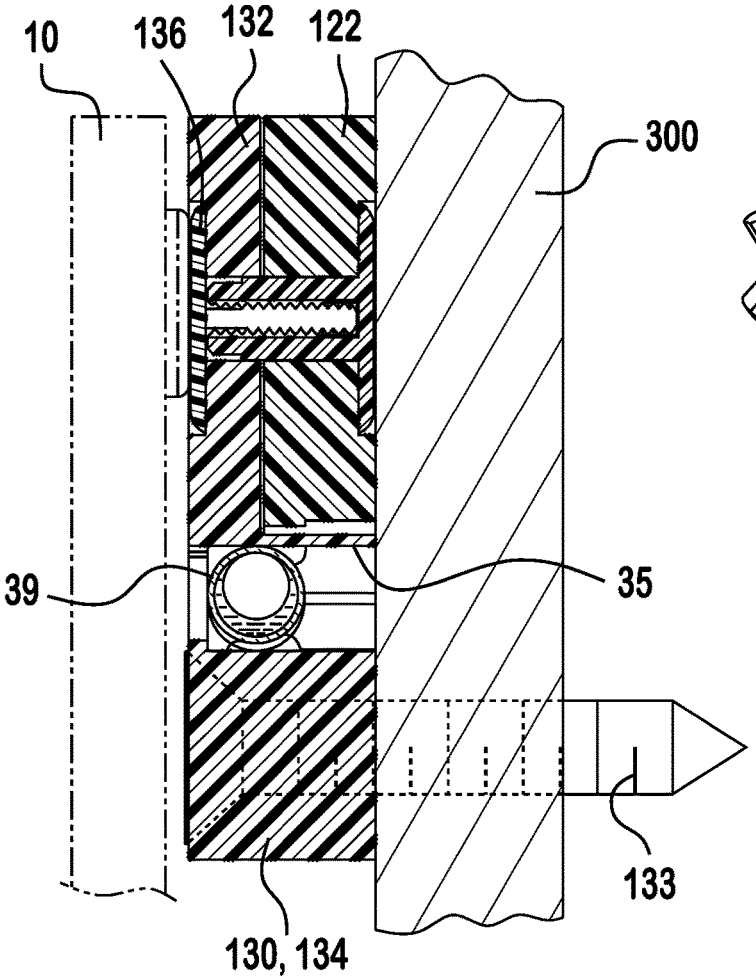
FIG. 19 is a cross-sectional view of the cleat and frame of FIG. 17 mounted to a structure.
Figure 25:
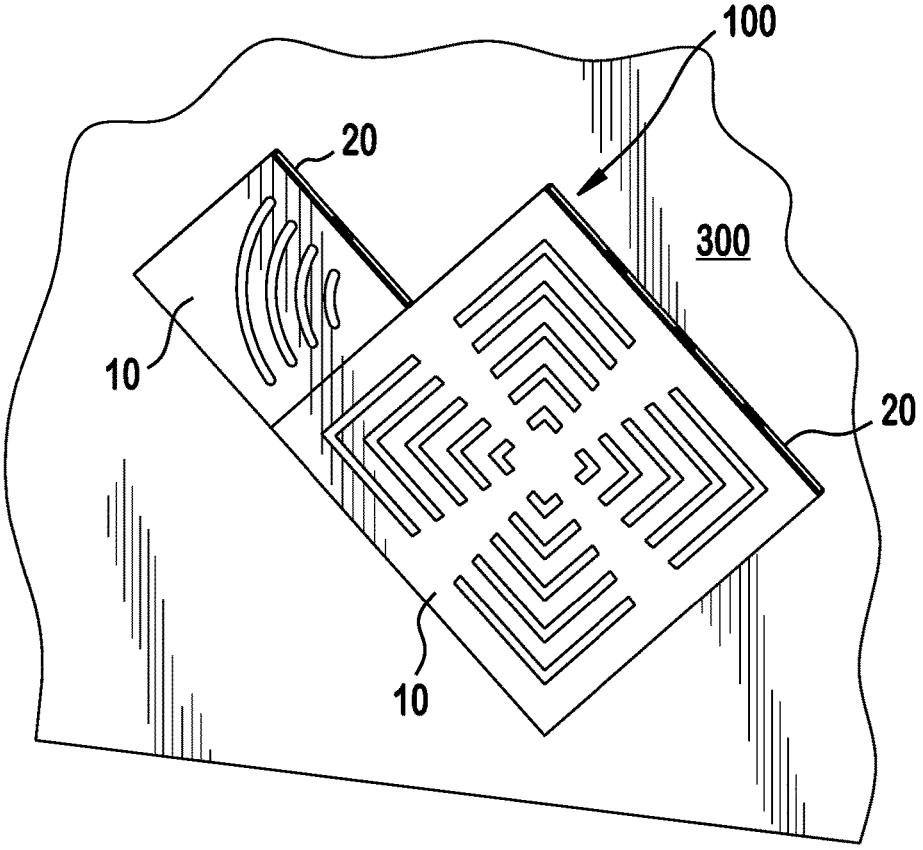
FIG. 25 is a perspective view of another assembled panel system according to an embodiment of the present disclosure.
Figure 26:
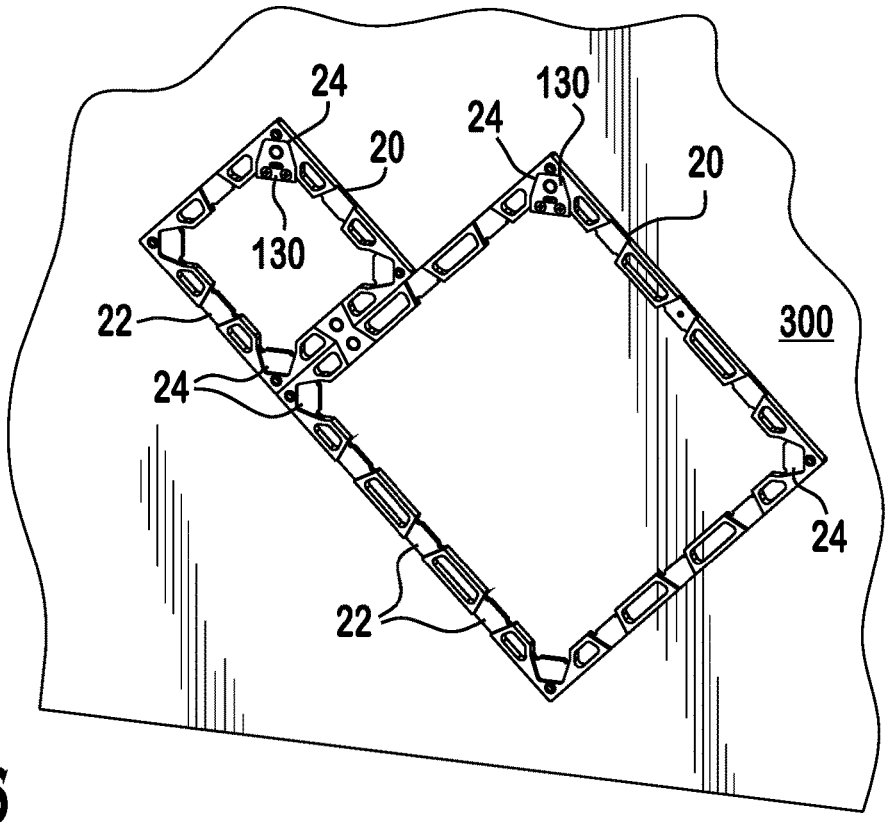
FIG. 26 is perspective view of the panel system of FIG. 25, with the exterior panels removed to reveal a corresponding frame assembly.

FIGS. 17-19 illustrate another embodiment of a cleat of hanger connector 130, wherein a pair of through-holes 137 are formed in a mounting portion 134 thereof for utilizing two corresponding fasteners 133 for securing the frame 20 to the mounting surface 300. Each mating portion 132 defines a through-hole 139 through which one-half of a fastener 136 is passed. A corresponding other half of the fastener 136 is passed through a corresponding through-hole 123 formed in a receiving section 122 of a frame 120, wherein securing the halves of the fastener(s) 136 together via the complementary ridged or toothed surfaces thereof positively attaches the cleat 130 to the frame 120. As shown in FIGS. 25 and 26, the above-described hanger 130 has been inserted into a corner, angled receiving section 24 of each of the two interconnected frames 20, thereby defining two mounting locations for fixing the frame assembly in a like-wise angled orientation (i.e., 45 degrees offset from vertical or horizontal) on the mounting surface 300.

Figure 15:
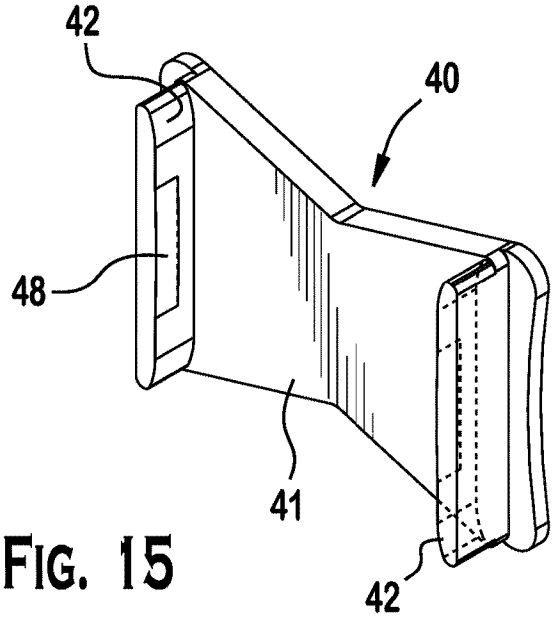
FIG. 15 is a rear perspective view of the frame-to-frame connector of FIG. 14.
Figure 14:
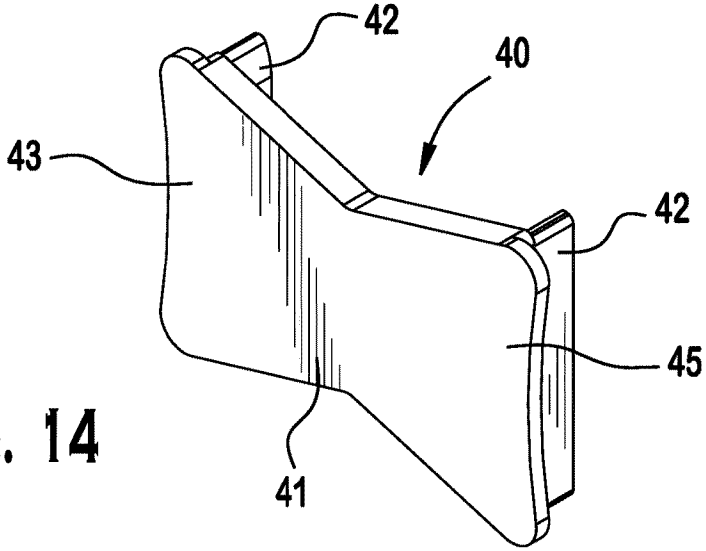
FIG. 14 is a front perspective view of a frame-to-frame connector according to an embodiment of the present disclosure.
Figure 16:
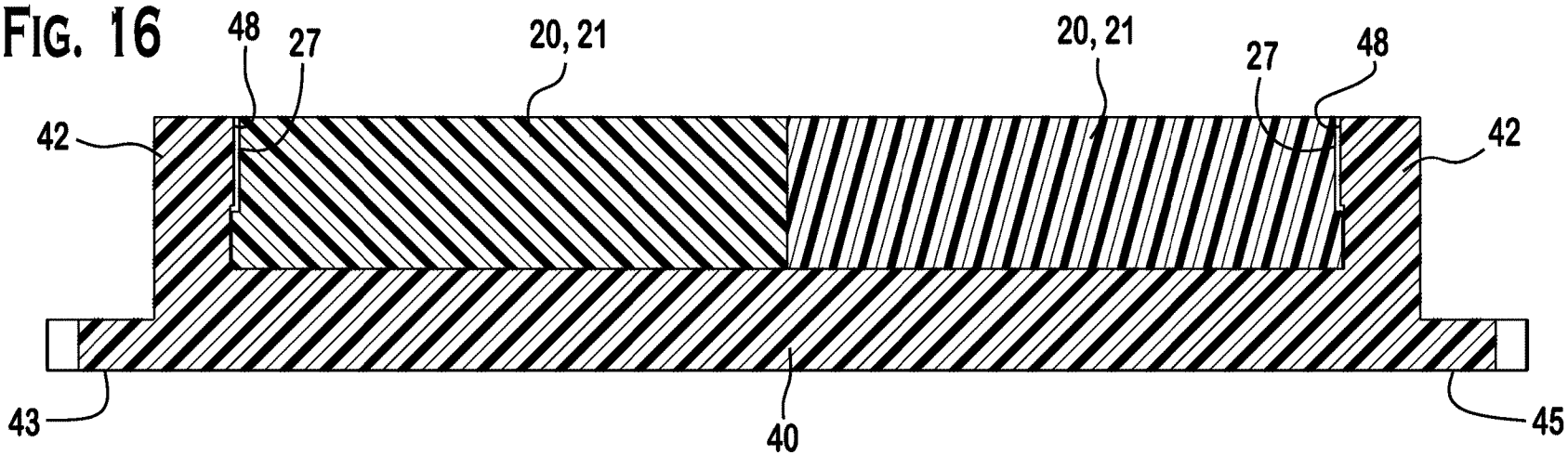
FIG. 16 is a cross-sectional view of the frame connector of FIGS. 14 and 15 joining two adjacent frame members.

FIGS. 14-16 illustrate the frame-to-frame connector 40 in greater detail, including a center body section 41 defining a generally "bow-tie" shape, with each side 43,45 thereof having a dovetail a profile tapering or narrowing toward one another in an opposing manner. The body section 41 is sized and shaped so as to fit into abutting receiving sections 22 of adjacent frames 20, securing them together in the illustrated "key-fit" manner (see FIG. 3). The body section 41 further includes protruding legs or ribs 42 extending in a direction transverse to the longitudinal direction of the body and are adapted to abut respective interior sides of the frame 20, capturing the sidewalls/receiving sections 22 of each frame therebetween. Each leg 42 may further define a protruding surface (or a recess) 48 configured to engage with a corresponding recess 27 (or protrusion) formed on an interior surface of the frame 20 for providing a snap-fit connection of the connector 40 with each adjacent frame member 20, further fixing the connector 40 relative to the frames 20.

Figure 20:
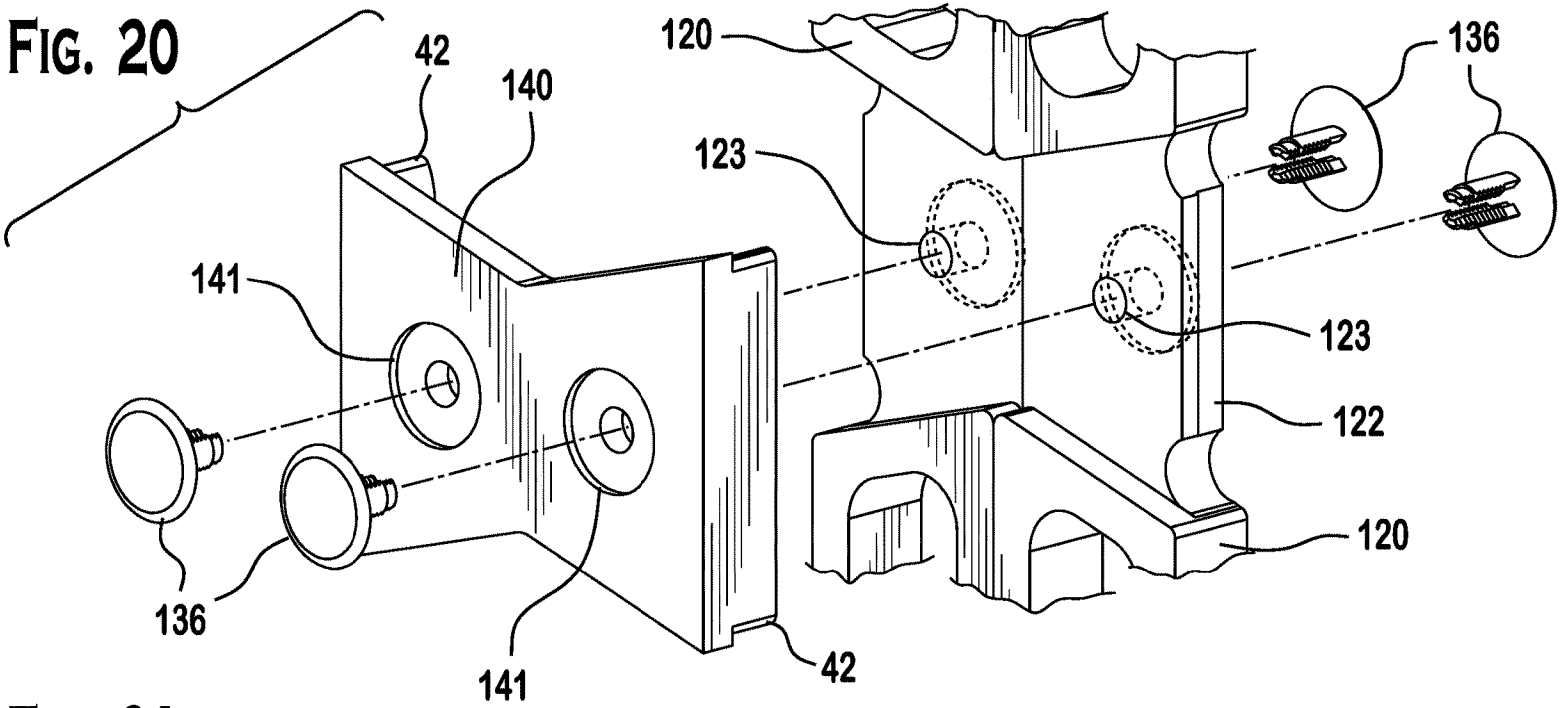
FIG. 20 is an exploded perspective view of another frame-to-frame connector and corresponding frame members according to an embodiment of the present disclosure.
Figure 21:
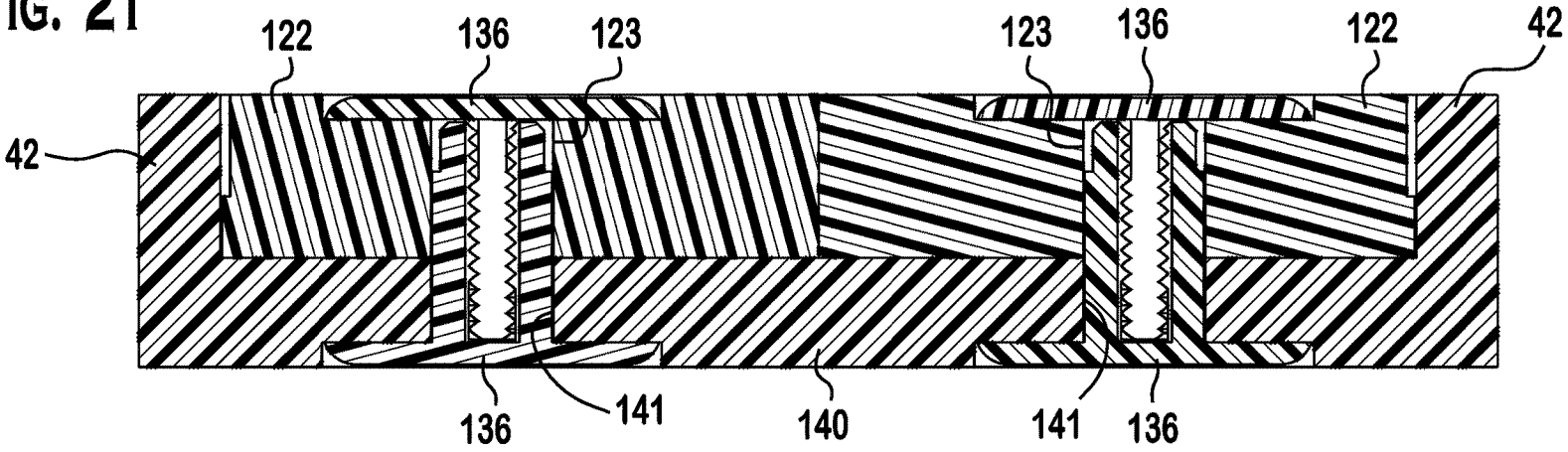
FIG. 21 is a cross-sectional view of the connector and frame members of FIG. 20 in an assembled state.

FIGS. 20 and 21 illustrate another embodiment of a frame-to-frame connector 140 which includes through-holes 141 formed therethrough for receiving one-half of the fastener 136. A corresponding other half of the fastener 136 is passed through each of the corresponding through-holes 123 formed in a frame 120 in the area of receiving sections 122 sections. Securing the halves of the fastener 136 together positively fastens the connector 140 to the adjacent frames 120. In the embodiment of FIGS. 22-24, the connector 140 receives two fasteners 236 therethrough for securing to the frames 120. Each fastener 236 includes a push-pin, or expanding rivet-type configuration, with an elastically deformable head portion 237 configured to engage with a corresponding recess or counterbore 125 defined by the through holes 123 formed in the frames 120. The fasteners 236 provides a snap-fit engagement with the frames 120, without requiring access to a back side thereof, as with the embodiments utilizing a two-part fastener.

Figure 27:
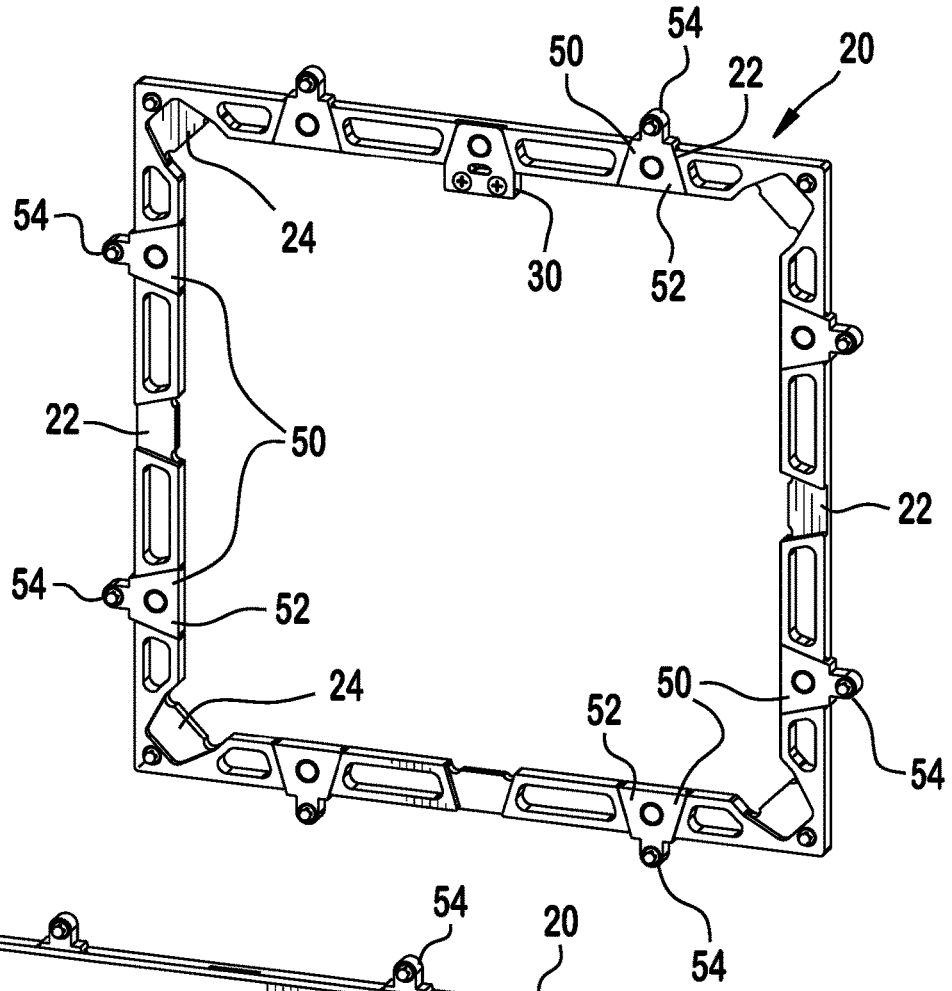
FIG. 27 is a perspective view of a frame assembly including border connectors according to an embodiment of the present disclosure.
Figure 31:
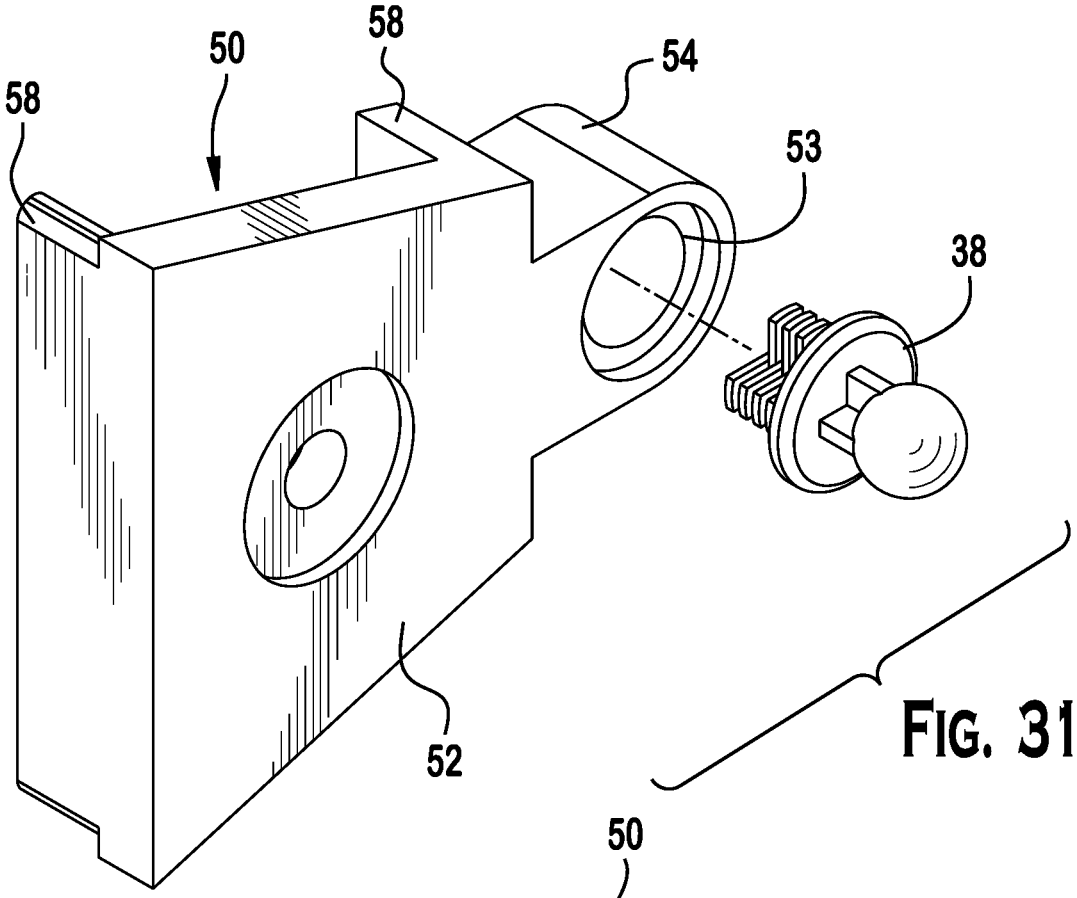
FIG. 31 is an exploded front view of a border connector according to an embodiment of the present disclosure.
Figure 32:
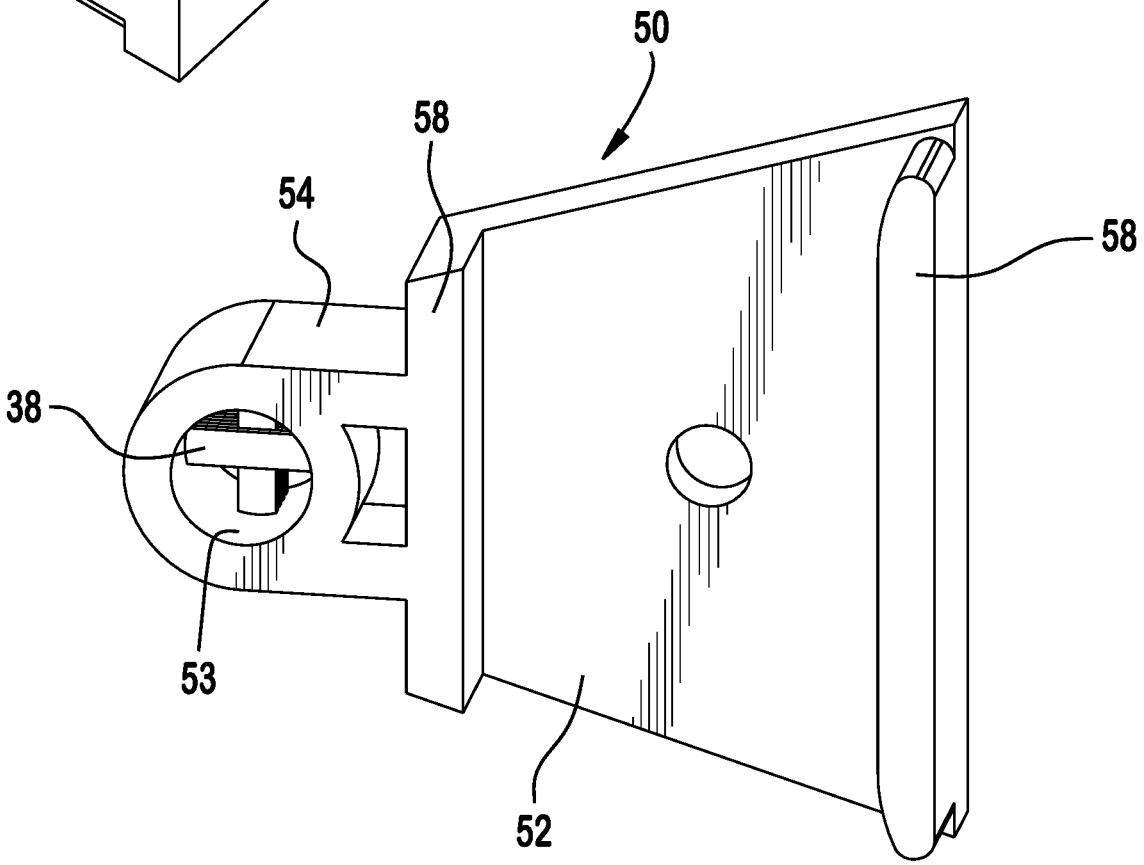
FIG. 32 is an assembled rear view of the border connector of FIG. 31.

FIGS. 27-47 illustrate a border system according to embodiments of the present disclosure. Referring to FIG. 27, the exemplary frame 20 is shown with a plurality of border connectors 50 fitted thereto. Each border connector 50 includes a "half bow-tie" shaped mating portion 52 having a thickness and taper matching that of the receiving section 22 into which it is fit or received in the illustrated manner. See also FIGS. 31 and 32. Also shown in FIGS. 31 and 32, each border connector 50 may further include a pair of protruding legs 58, similar to those set forth with respect to FIGS. 14-16 for engaging with corresponding features of the frame 20 (e.g., notched sections thereof on an interior wall) for providing a snap-fit connection therebetween. The border connector 50 further defines a mounting portion 54 having a thickness greater than that of the mating portion 52, and approximately equal to that of a thickness of the frame 20. The mounting section 54 may define an aperture 53 configured to receive a male border fastener of connector 38 (as also shown in FIG. 7) therein for mating with a complementary female connector of a border element (or vice versa), such as a cup or socket 28 as shown in the previous embodiments. The border connector 50 may be secured to the frame 20 via fastening means, such as those set forth in FIG. 17-19 or 22-24, the details of which are not repeated herein for the purpose of brevity.

Figure 28:
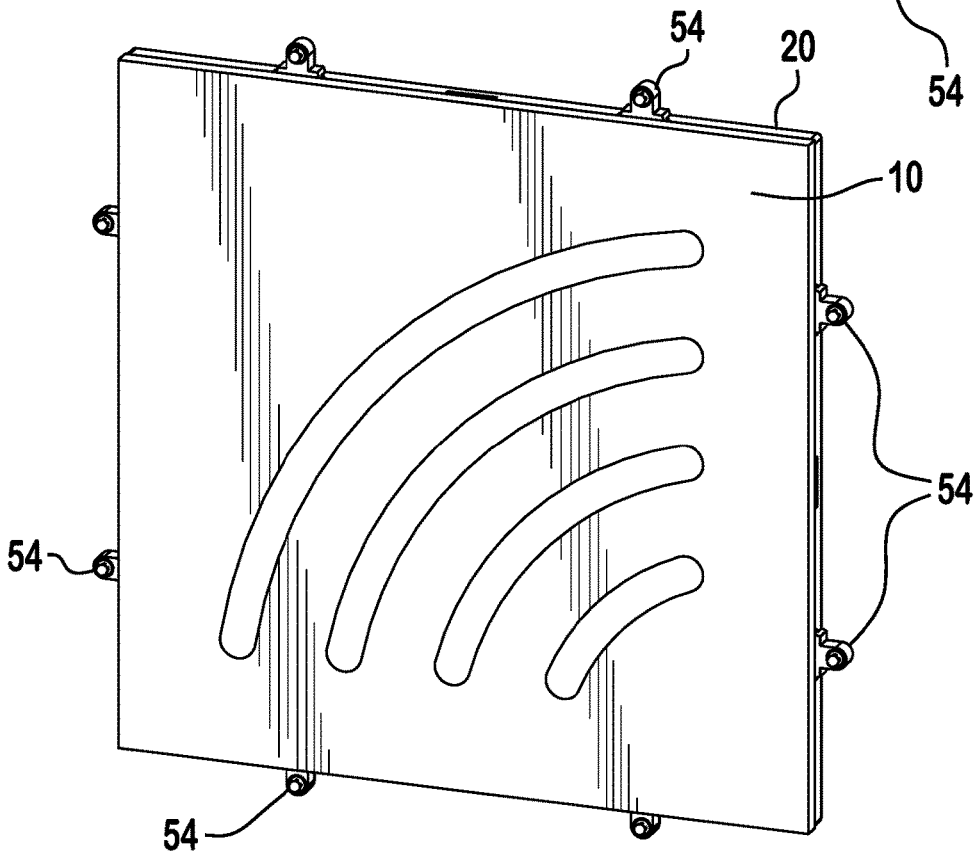
FIG. 28 is a perspective view of the frame assembly of FIG. 27, with an exterior panel installed thereon.
Figure 29:
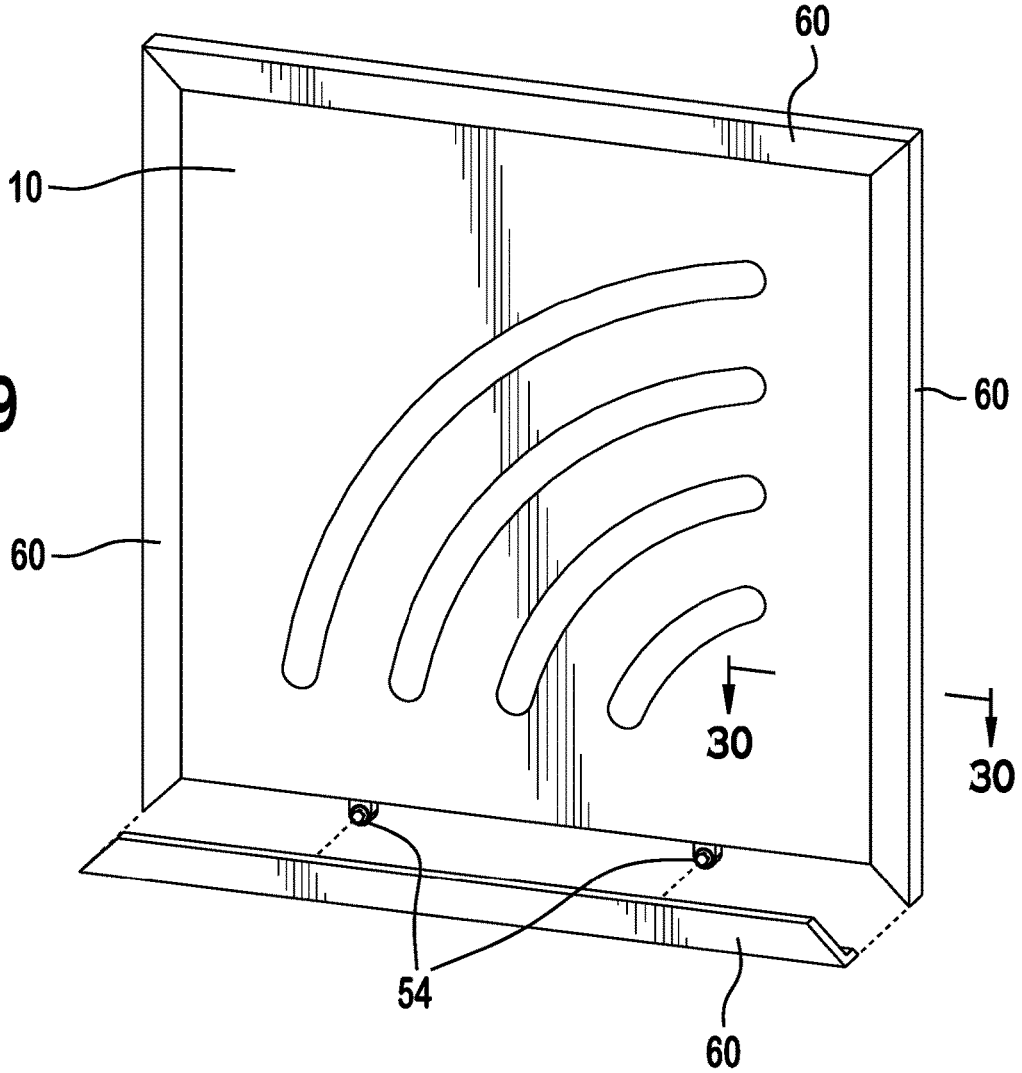
FIG. 29 is a perspective view of the frame assembly of FIGS. 27 and 28, with border members partially installed thereon.
Figure 30:
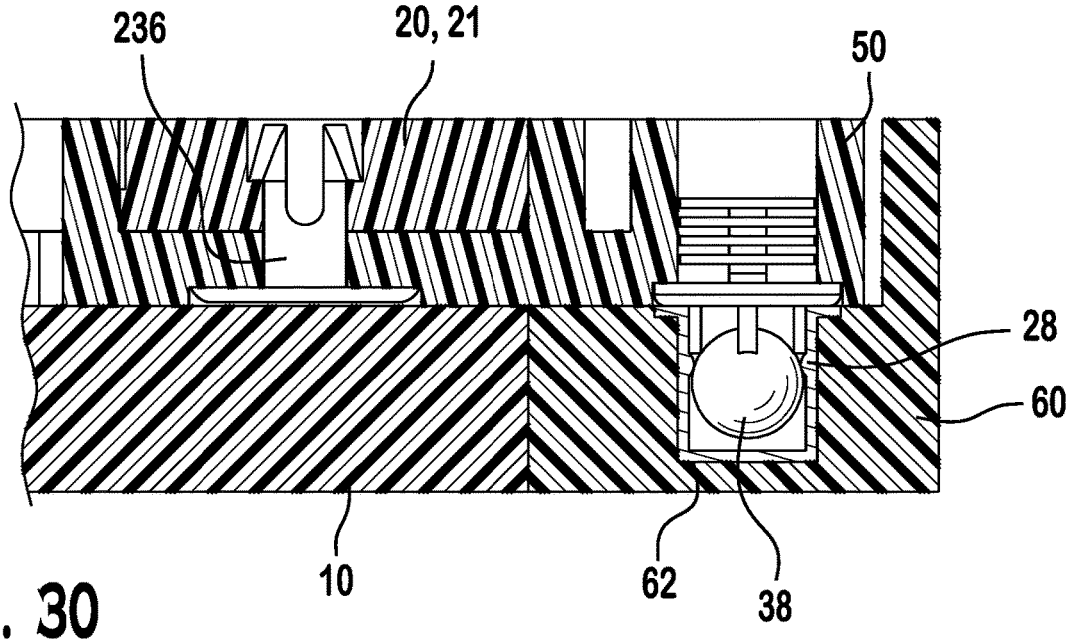
FIG. 30 is a partial cross-sectional view of the frame assembly of FIG. 29 taken along line 30-30.
Figure 33:
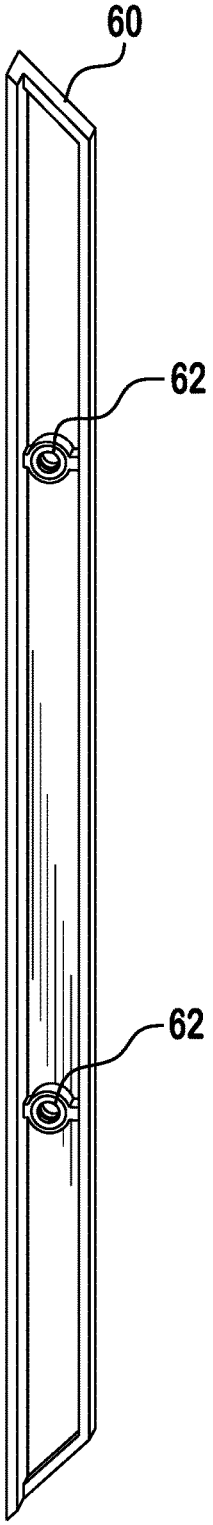
FIGS. 33-35 are rear views of a plurality of distinct borders connectable to frame assemblies of the present disclosure.
Figure 34:
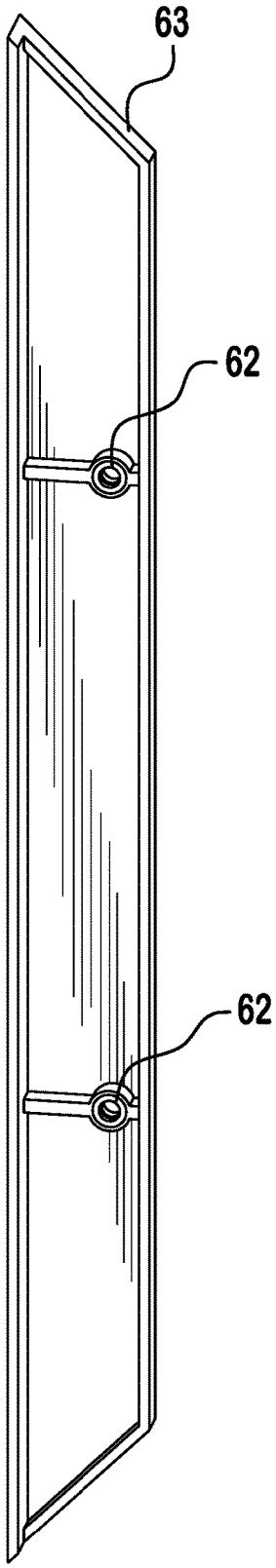
Figure 35:
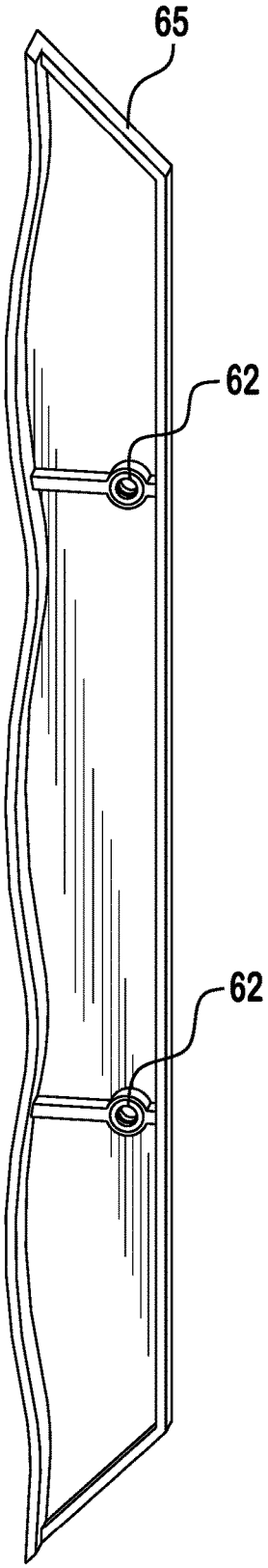

Referring to FIG. 28, a panel 10 is fitted over the frame 20, covering the mating portions 52 of each connector 50, while leaving the mounting portions 54 exposed for interfacing with and connecting to a plurality of border elements 60, as shown in FIG. 29. As will be understood for the figures, each border element 60 may define an aperture 62 formed on an underside thereof and adapted to receive the connector 28. The connector 38 and the connector 28 engage in a snap-fit manner, as described above with respect to FIGS. 7 and 8. The use of shared fasteners for securing both the panels 10 and the borders 60 to the frames 20 result in reduced system complexity and lower production costs. FIGS. 33-35 illustrate various border elements 60,63,65, with border element 63 having a thicker width compared to that of the border element 60, and the border element 65 having a non-linear exterior or external profile.

Figure 36:
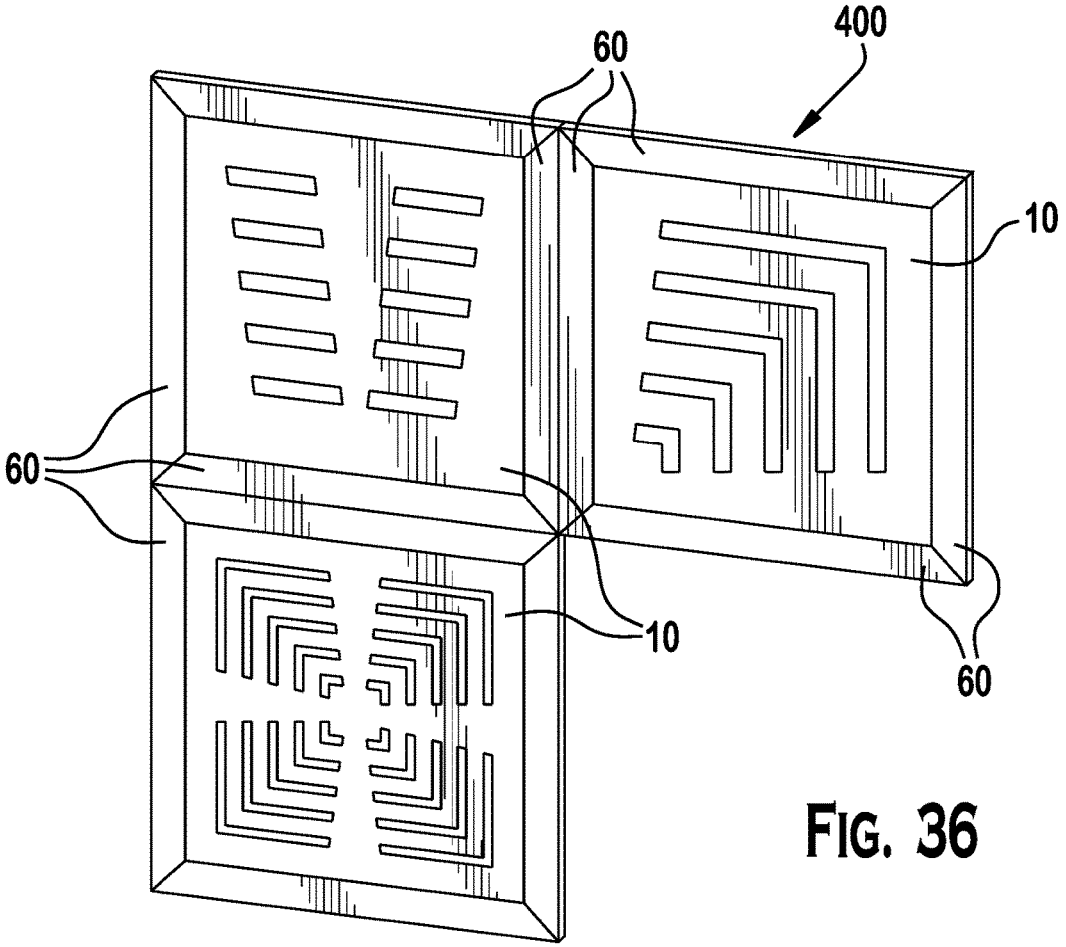
FIG. 36 is a front perspective view of a panel system including borders fitted between adjacent panels according to an embodiment of the present disclosure.
Figure 37:
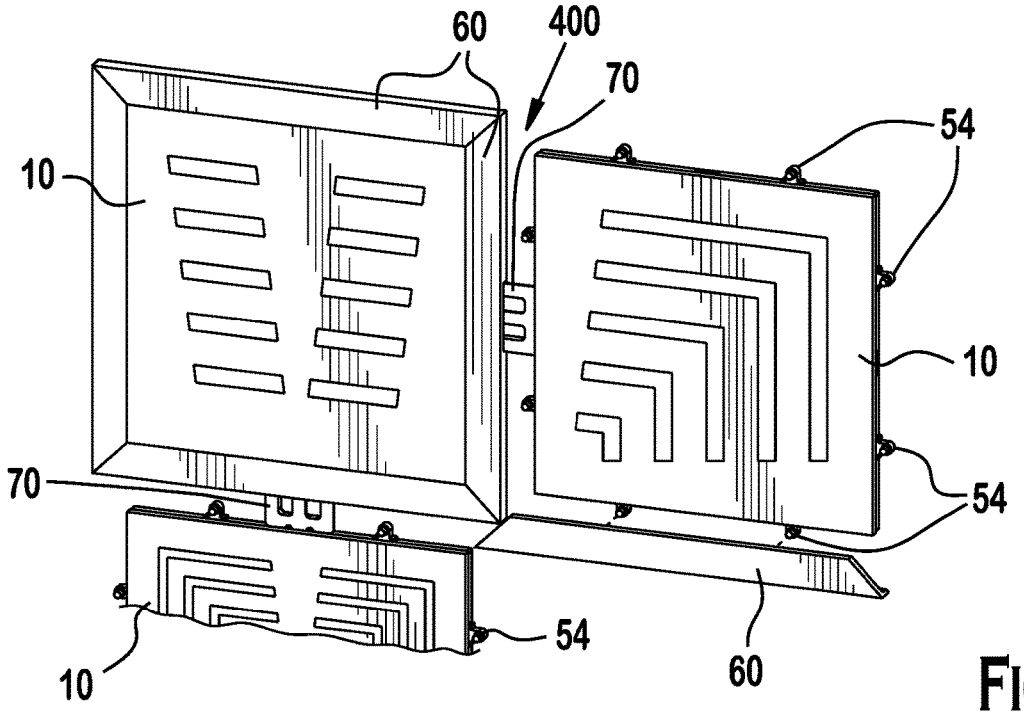
FIG. 37 is a perspective view of the panel system of FIG. 36 with a portion of the borders removed.
Figure 38:
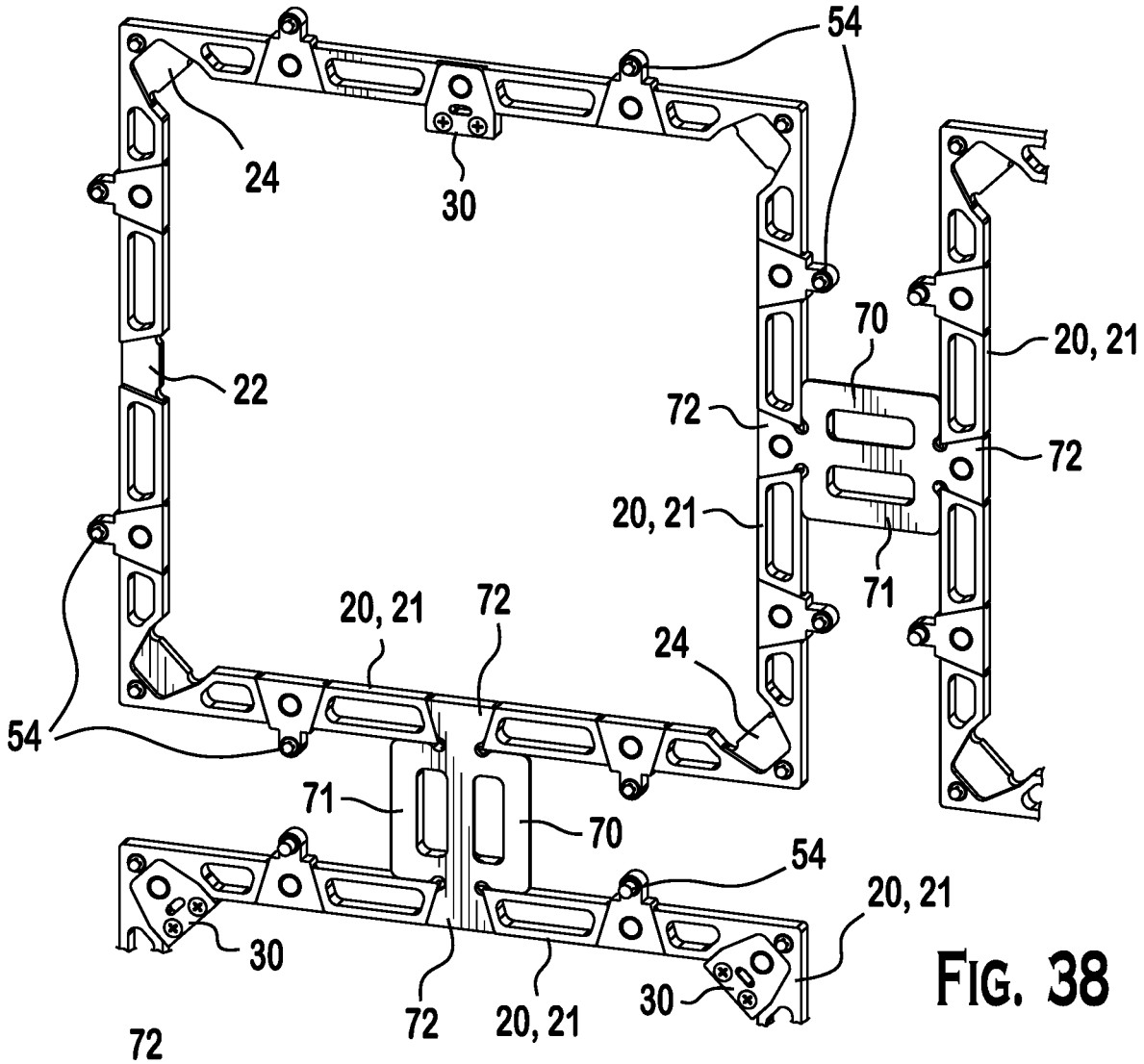
FIG. 38 is a perspective view of the panel system of FIG. 36 with the exterior panels and borders removed to reveal a corresponding frame assembly.

FIGS. 36-42 illustrate panel and frame assemblies which utilize an offsetting or spacing frame-to-frame connector or a temporary spacing tool in order to achieve separation between frames for accommodating, for example, border elements arranged therebetween. Specifically, the exemplary panel assembly 400 includes a plurality of interconnected panels 10, each having a border defined about is perimeter via a plurality of border elements 60, as shown in FIG. 36. With reference to FIG. 37, the border elements 60 associated with one of the panels 10 have been removed, revealing a spacer or offsetting frame-to-frame connector or spacing tool 70 according to embodiments of the present disclosure. As shown in greater detail in FIG. 38, the connector 70 includes opposingly-tapering mating portions 72 having features similar to those set forth above with respect to the frame-to-frame connectors 40. In distinction to the connecter 40, however, the connector 70 further includes a central body portion 71 arranged and extending between the mating portions 72, and creating an offset distance between interconnected sidewalls 21 of the frames 20. The connector 70 may be utilized temporarily as a removable installation tool for setting a correct spacing and orientation (i.e. parallel to one another) of the frames 20, wherein it is removed prior to the installation of the panels and/or border elements. Likewise, the connector 70 may form part of the frame assembly, and remain installed ensuring proper spacing is maintained. As will be understood from the figures, the width of the central body portion 71 may corresponding to approximately double the width of each border element 60, such that the use of the connector 70 provides a gap between each frame 20 sized to accommodate two adjacent border elements 60.

Figure 44:
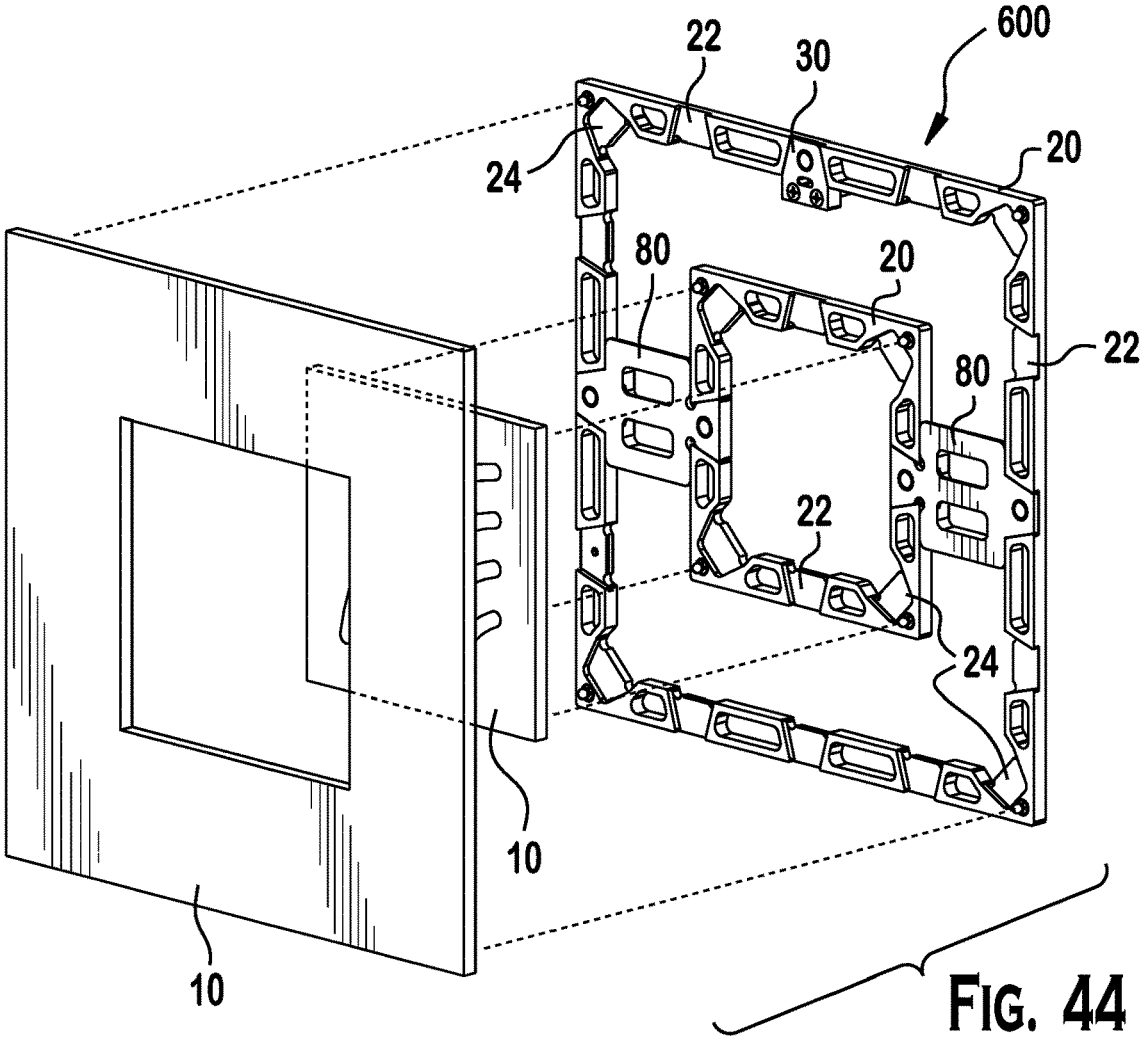
FIG. 44 is an exploded view of the panel system of FIG. 43.
Figure 46:
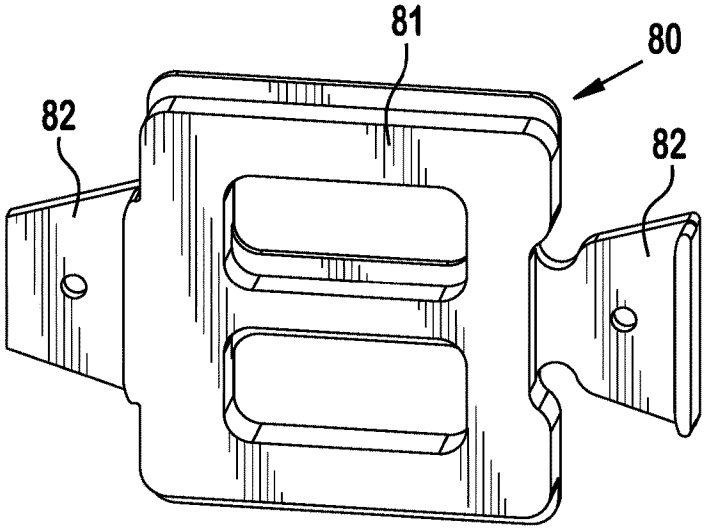
FIG. 46 is a rear perspective view of the connector of FIG. 45.
Figure 45:
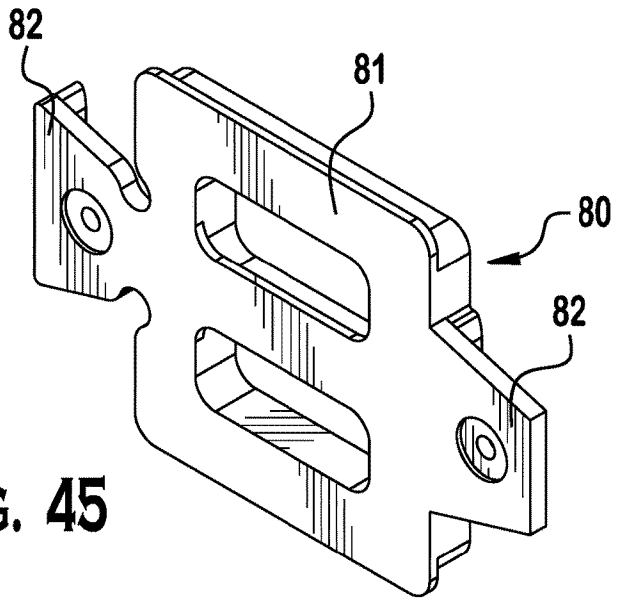
FIG. 45 is a front perspective view of a frame-to-frame connector according to another embodiment of the present disclosure as shown in FIG. 44.
Figure 47:
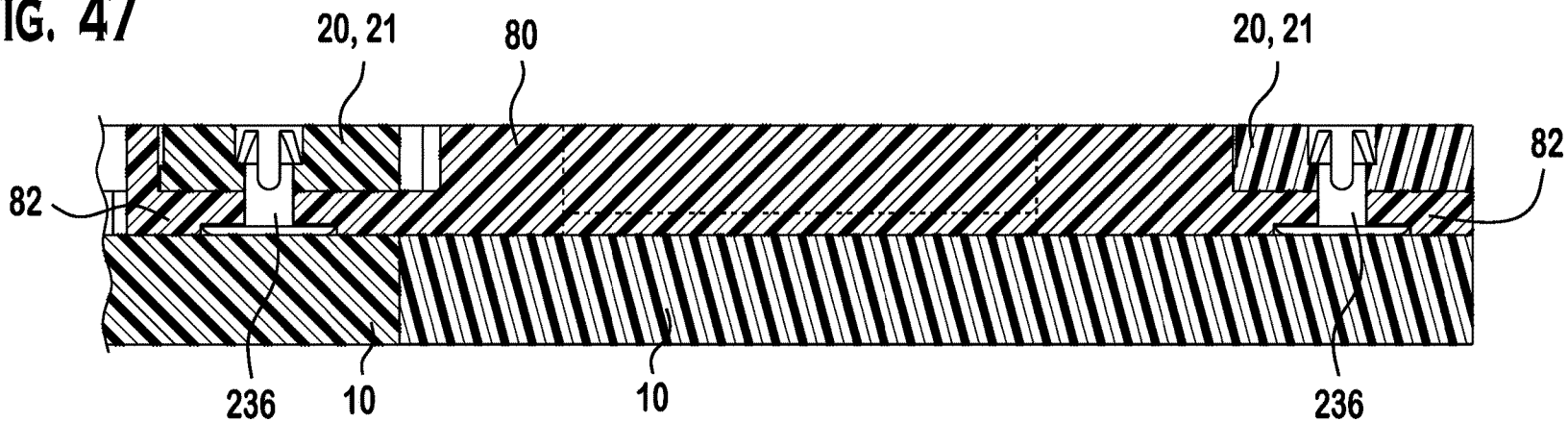
FIG. 47 is a cross-sectional view of the connector of FIGS. 45 and 46 and corresponding frame members in an assembled state.

FIGS. 43-47 illustrate another embodiment of a panel assembly 600 according to the present disclosure including a first frame 20 mounted within a second frame 20, as distinct from adjacently mounted frames as shown in the preceding embodiments. This arrangement is achieved via an offsetting or spacing tool or frame-to-frame connector 80 according to another embodiment of the present disclosure. Using the connector 80, an outer panel 10 or border may be secured to the second frame 20, and a central panel 10 secured to the first frame 20, as shown in FIG. 44. The connector 80 includes a central body portion 81 similar to that of connector 70, as well as two tapered mating portions 82 arranged on opposite ends thereof. The mating portions 82 each taper in the same direction, as distinct from opposing directions as set forth with respect to the other frame-to-frame connectors described herein, such that they may be fitted to the receiving sections 22 of the frames 20 in the illustrated manner. Each of the connectors 70 and 80 and associated receiving sections 22 of the frames include features similar to those set forth above with respect to the preceding embodiments, as shown in the figures. Accordingly, repetitive detailed descriptions of these features are omitted herein.

Figure 39:
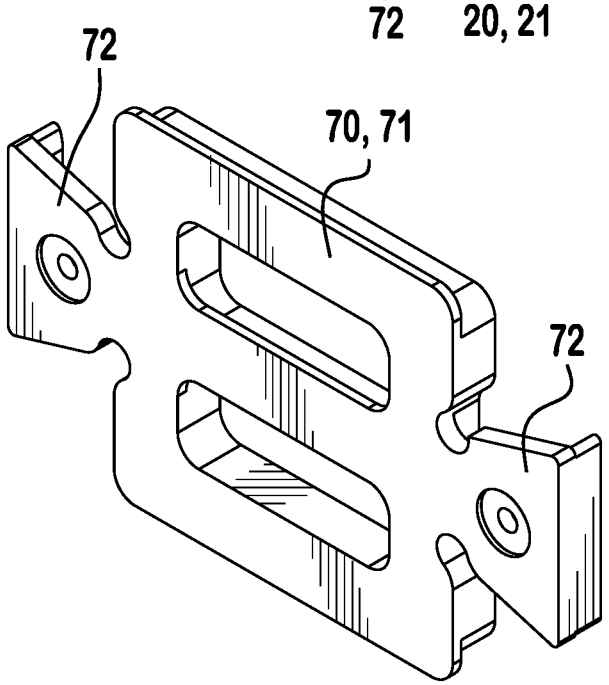
FIG. 39 is a front perspective view of a frame-to-frame connector according to another embodiment of the present disclosure.
Figure 41:
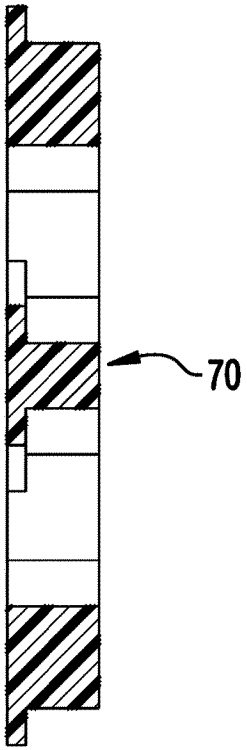
FIG. 41 is a cross-sectional view taken alone line 41-41 of the connector of FIG. 39.
Figure 40:
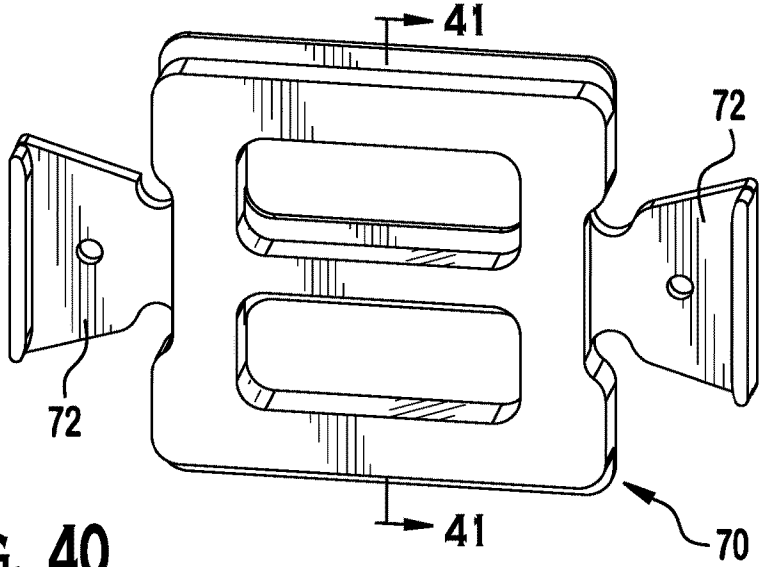
FIG. 40 is a rear perspective view of the connector of FIG. 39.
Figure 42:
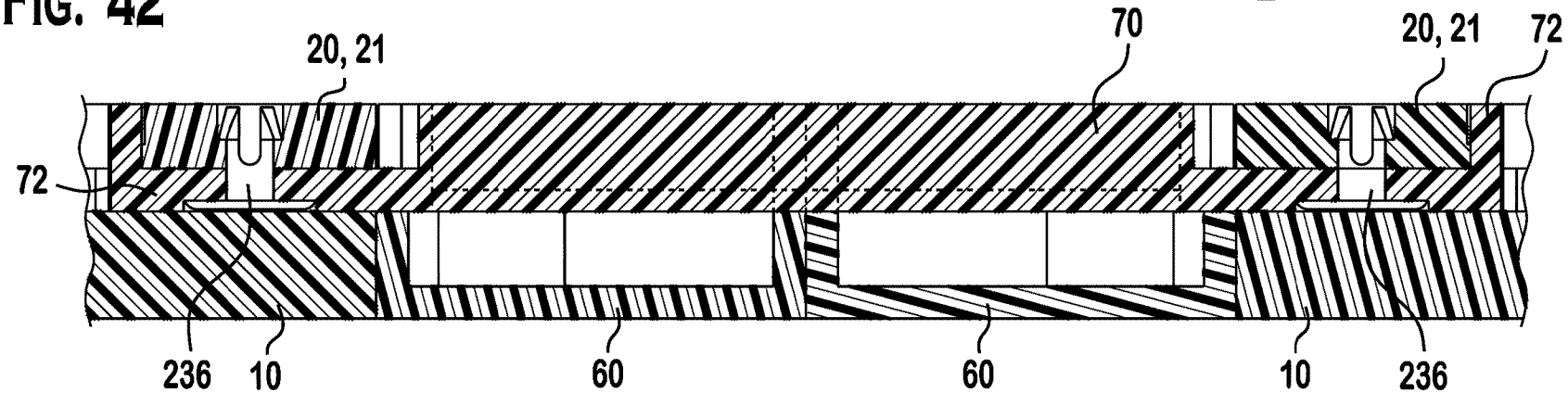
FIG. 42 is a cross-sectional view of the connector of FIG. 39 and corresponding frame members in an assembled state.
Figure 43:
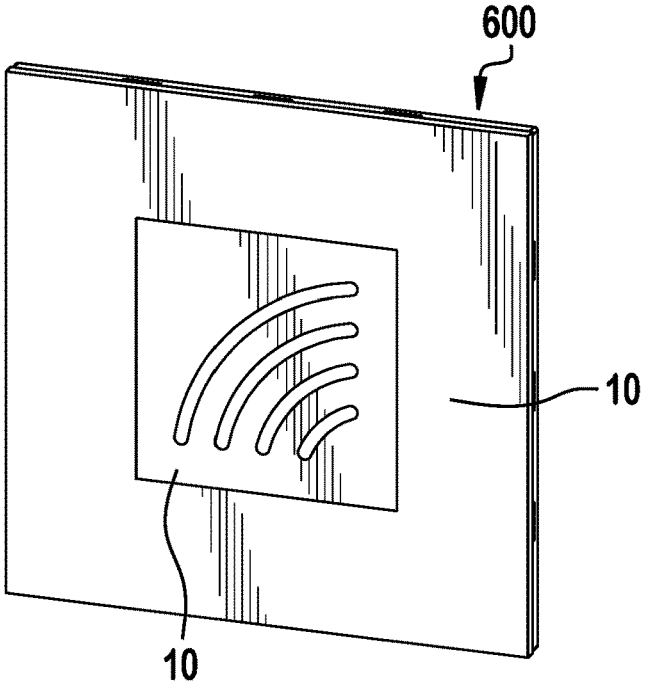
FIG. 43 is a perspective view of another panel system according to an embodiment of the present disclosure.
Figure 48:
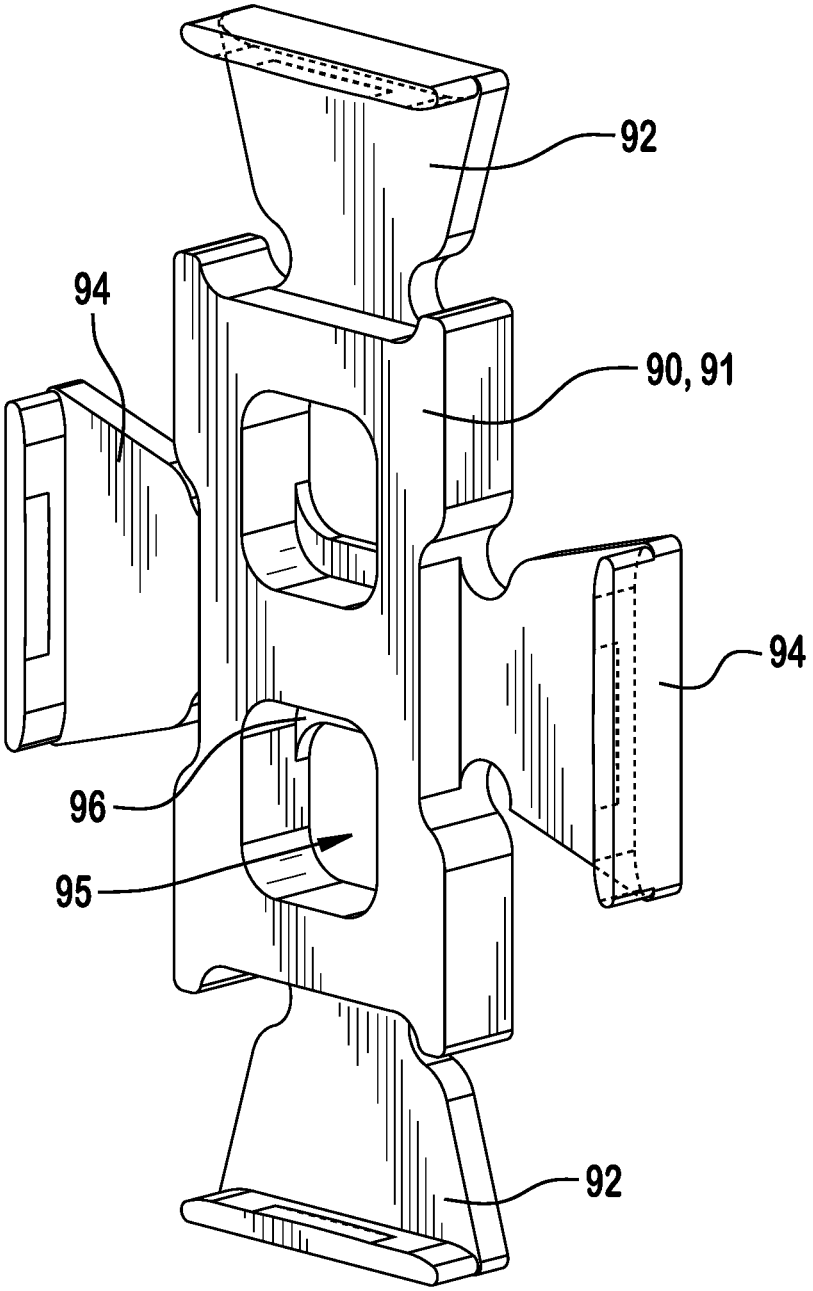
FIG. 48 is a front perspective view of a frame-to-frame connector according to another embodiment of the present disclosure as shown.

The connector or spacing tool 90 shown in FIG. 48 includes features similar to those set forth above with respect to FIGS. 39 and 40, for example. Specifically, the connector 90 comprises a body 91 having first and second mating portions 92 on opposite first sides thereof. The body 91 further includes a second set of mating portions 94, with each formed on opposite second elongated sides of the body 91. As shown in the figure, the first pair of mating portions 92 are spaced apart from one another at a first distance, and the second pair of mating portions 94 are spaced apart from one another by a second distance, less than the first distance as defined by the length and width of the body 91. As the spacing between the first mating portions 92 and the second mating portions 94 is different, the connector 90 may be used, for example, as a tool for setting the spacing between adjacent frames 20 at either one of the two distances. In this way, the connector 90 defines a multi-use tool, reducing a number of connectors (or tools) required to assemble a system according to embodiments of the present disclosure. Still referring to FIG. 48, a pair of openings 95 are define through the body 91, wherein the body further defines a lip or protrusion 96 extending into each opening 95 proximate an outwardly-facing side of the connector 90. The openings 95 and protrusions 96 define gripping surfaces configured to be engaged by, for example, the fingers of a user for enabling a firm grasp of the connector 90 during use.

While the foregoing invention has been described with reference to the above-described embodiment, various modifications and changes can be made without departing from the spirit of the invention. Accordingly, all such modifications and changes are considered to be within the scope of the appended claims. Accordingly, the specification and the drawings are to be regarded in an illustrative rather than a restrictive sense. The accompanying drawings that form a part hereof, show by way of illustration, and not of limitation, specific embodiments in which the subject matter may be practiced. The embodiments illustrated are described in sufficient detail to enable those skilled in the art to practice the teachings disclosed herein. Other embodiments may be utilized and derived therefrom, such that structural and logical substitutions and changes may be made without departing from the scope of this disclosure. This Detailed Description, therefore, is not to be taken in a limiting sense, and the scope of various embodiments is defined only by the appended claims, along with the full range of equivalents to which such claims are entitled.

Such embodiments of the inventive subject matter may be referred to herein, individually and/or collectively, by the term "invention" merely for convenience and without intending to voluntarily limit the scope of this application to any single invention or inventive concept if more than one is in fact disclosed. Thus, although specific embodiments have been illustrated and described herein, it should be appreciated that any arrangement calculated to achieve the same purpose may be substituted for the specific embodiments shown. This disclosure is intended to cover any and all adaptations of variations of various embodiments. Combinations of the above embodiments, and other embodiments not specifically described herein, will be apparent to those of skill in the art upon reviewing the above description.

What is claimed is:

1. A modular display system, comprising:

a plurality of frames, each frame including:

at least one sidewall; and a plurality of connector receiving sections defined by the at least one sidewall and arranged about a perimeter of the frame, each connector receiving section defining a recess formed through the at least one sidewall in a width direction thereof, the recess of each connector receiving section includes a tapered profile in the width and extends generally between an interior side of the at least one sidewall and an exterior side of the at least one side wall;

a body of each frame connector having:

a first side having a width tapering toward a center of the body, and a second side positioned opposite the first side and having a width tapering in a direction away from the center of the body for securing one of the plurality of frame sidewalls within another one of the plurality of frame sidewalls; and at least one frame connector selectively fixable within connector receiving sections of two frame sidewalls of the plurality of frames for connecting two frames together.

2. The modular display system of claim 1, wherein each frame connector includes a body having:

a first side with a width tapering toward a center of the body, and a second side positioned opposite the first side and having a width tapering toward the center of the body for connecting to adjacent frame sidewalls together.

3. The modular display system of claim 1, wherein the connector is sized so as to connect abutting sides of the two frame sidewalls together.

4. The modular display system of claim 1, wherein the connector is sized so as to connect respective sidewalls of the two frames together with a predetermined offset defined therebetween.

5. The modular display system of claim 1, wherein each frame connector includes the body having the first side and the second side opposite the first side, each of the first and second sides defining a respective first and second protrusion extending therefrom in a direction transverse to a longitudinal direction of the connector, the first and second protrusions engaging with respective interior sides of each of the two connected frame sidewalls such that the two connected sidewalls are arranged between the first and second protrusions.

6. The modular display system of claim 5, wherein each of the protrusions is configured to engage with complementary recess formed on the interior sides of the frame sidewalls.

7. The modular display system of claim 1, further comprising first and second fasteners for securing the frame connector to the two connected frame sidewalls.

8. The modular display system of claim 1, further comprising a cleat sized to be received within one of the receiving sections, the cleat adapted to extend into an interior space defined by the at least one sidewall and defining at least one through-hole configured to receive a fastener therethrough for fixing the plurality of frames to a mounting surface.

9. The modular display system of claim 1, further comprising at least one panel removably attached to a front face of at least one of the plurality of frames.

10. The modular system of claim 9, further comprising a panel connector adapted to removably attach the at least one panel to the front face of the at least one of the plurality of frames.

11. The modular system of claim 10, wherein the panel connector defines a socket and a protrusion configured to be removably engaged with the socket.

12. The modular system of claim 1, further comprising a border connector receivable within one of the plurality of receiving sections for connecting a border an exterior side of a sidewall of one of the plurality of frames.

13. A modular display system, comprising:

a plurality of frames, each of the frames having sidewall connected to a sidewall of an adjacent frame by a frame connector;

at least one panel removably attached to a front face of the plurality of frames by a panel connector;

a border element attached to an exterior side of a sidewall of one of the plurality of frames by a border connector;

a mounting cleat extending from an interior side of a sidewall of one of the plurality of frames for mounting the display system to an adjacent mounting surface; and a body of the frame connector having:

a first side having a width tapering toward a center of the body, and a second side positioned opposite the first side and having a width tapering in a direction away from the center of the body for securing one of the plurality of frame sidewalls within another one of the plurality of frame sidewalls.

14. The modular display system of claim 13, wherein each of the plurality of frames further includes a plurality of connector receiving sections defined by at least one sidewall of the frame are arranged about a perimeter of the frame, each connector receiving section defining a commonly-sized recess formed through the at least one sidewall in a width direction thereof, and wherein:

the frame connector is selectively fixable within connector receiving sections of two frame sidewalls of the plurality of frames for connecting two frames together, the border connector is selectively fixable within a connector receiving section of one of the plurality of frames, and the mounting cleat is selectively fixable within a connector receiving section of one of the plurality of frames.

15. The modular display system of claim 14, wherein the recess of each connector receiving section includes a profile tapering in the width direction from an interior side of the at least one sidewall to an exterior side of the at least one sidewall.

16. The modular display system of claim 13, wherein the frame connector includes the C-shaped body including a first end and a second end opposite the first end, each of the first and second ends defining a protrusion extending therefrom in a direction transverse to a longitudinal direction of the connector, the first and second protrusions engaging with respective interior sides of each of the two connected frame sidewalls.

17. The modular display system of claim 13, further comprising a plurality of fasteners fixing the frame connector, the border connector and the mounting cleat within a respective receiving section.

* * * * *